US005761315A

United States Patent [19]

Iida et al.

[11] Patent Number: 5,761,315

[45] **Date of Patent: *Jun. 2, 1998**

[54] SURROUND SIGNAL PROCESSING APPARATUS

[75] Inventors: Toshiyuki Iida, Kawasaki; Tomohiro Mouri, Tokyo-To; Yasuhisa Okabe, Isehara, all of Japan

[73] Assignee: Victor Company of Japan, Ltd., Yokohama, Japan

[ * ] Notice: The term of this patent shall not extend beyond the expiration date of Pat. No. 5,579,396.

[21] Appl. No.: 693,009

[22] Filed: Aug. 6, 1996

Related U.S. Application Data

[63] Continuation of Ser. No. 283,757, Aug. 1, 1994, Pat. No. 5,579,396.

[30] Foreign Application Priority Data

Jul. 30, 1993 [JP] Japan ..... 6-208872

[51] Int. Cl.[6] ..... H04R 5/00

[52] U.S. Cl. ..... 381/18; 381/19; 381/1; 381/24

[58] Field of Search ..... 381/1, 18, 19, 381/17, 61, 24, 23, 25

[56] References Cited

U.S. PATENT DOCUMENTS

| | | | |
|---|---|---|---|
| 3,236,949 | 2/1966 | Atal et al. | 381/1 |
| 4,159,397 | 6/1979 | Iwahara et al. | 381/19 |
| 4,349,698 | 9/1982 | Iwahara | 381/1 |
| 4,856,064 | 8/1989 | Iwamatsu | 381/18 |
| 5,177,798 | 1/1993 | Ohsawa | 381/18 |
| 5,590,204 | 12/1996 | Lee | 381/24 |

FOREIGN PATENT DOCUMENTS

| | | | |
|---|---|---|---|
| 0354519 | 8/1989 | European Pat. Off. . | |
| 42 41 130 | 12/1992 | Germany . | |
| 0096791 | 7/1980 | Japan | 381/1 |
| 6-78400 | 3/1994 | Japan . | |

OTHER PUBLICATIONS

Patent Abstracts of Japan, vol. 16 No. 123 (p. 1330), Mar. 27, 1992 & JP-A-32 090697 (Matsushita) Dec. 20, 1991.

"Prospects for Transaural Recording", J. Audio Eng. Soc., vol. 37, No. 1/2 1989, Jan./Feb., pp. 3–19.

*Primary Examiner*—Minsun Oh Harvey
*Attorney, Agent, or Firm*—Jacobson, Price, Holman & Stern, PLLC

[57] ABSTRACT

A surround signal processing apparatus by which an inputted rear surround signal can be reproduced, together with two-channel front stereophonic signals, through a pair of speakers arranged in front of and in substantially right-and-left symmetry about a listener, in such a way that two sound images of the reproduced rear surround signal can be localized at two predetermined positions relative to the listener. The inputted rear surround signal is processed by a filter. The signal processed by the filter is added to one of the stereophonic signals, and then outputted to one of the pair of speakers. Further, an inversion signal of the filter-processed signal is added to the other of the stereophonic signals, and then outputted to the other of the speakers. Here, the transfer characteristics of the filter are determined as follows: (F–K)/(S–A), where S denotes transfer characteristics between one of the speakers and one of the listener's ears positioned on the same side as the speaker, respectively; A denotes transfer characteristics between one of the speakers and one of the listener's ears positioned on an opposite side to the speaker, respectively; F denotes transfer characteristics between one of the two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes a reverse convolution calculation.

12 Claims, 18 Drawing Sheets

SPEAKER SETTING REQUIRED FOR USUAL SURROUND REPRODUCTION

ACTUAL SETTING

SURROUND SIGNAL PROCESSING APPARATUS

This is a continuation of application Ser. No. 08/283,757 filed Aug. 1, 1994, Pat. No. 5,579,396.

BACKGROUND OF THE INVENTION

1. Field of the Invention

The present invention relates generally to sound image localizing apparatus used when sound signals are reproduced through speakers, and more specifically to a surround signal processing apparatus used when surround signals are reproduced in such way as to surround a listener or listeners. Here, the sound image implies a virtual sound source image from which a listener feels that a sound is reproduced. Further, the sound image can be localized at any desired position away from a speaker or speakers.

2. Description of the Prior Art

Conventionally, in the case where stereophonic sound is reproduced in such a way as to provide a sound field expanding behind a listener or to localize a sound image behind a listener, two front speakers are arranged in front of a listener for stereophonic sound reproduction and at least one or two rear speaker are additionally arranged behind the listener for surround sound reproduction; in other words, at least three speakers must be arranged at the minimum around a listener. Further, in the case where surround sound is reproduced on the basis of a one-system surround signal or a center channel is additionally required to be reproduced as with the case of the 3–1 system of high vision HDTV (High Definition TV), one or two additional center speakers must be arranged. Therefore, amplifiers and cables corresponding to the numbers of the reproduced channels are necessary.

In other words, as shown in FIG. 1A for instance, in the case of the surround sound reproduction, it has been necessary to arrange two front L(left)- and R(right)-channel speaker sets for stereophonic sound on front left and right sides of a listener LM, two rear SL(surround left)- and SR(surround right)-channel speaker sets for surround sound on rear left and right sides thereof, and further a C(center)-channel speaker at the front middle thereof, respectively.

In ordinary homes, however, since it is difficult to arrange the two rear speakers and the center speaker from the standpoint of space and cost, in practice as shown in FIG. 1B, only L- and R-channel speakers are installed on the front left and right sides of a listener LM. In this speaker arrangement, it has become impossible to obtain sufficient surround sound effect. In the case of the surround reproduction system using a monophonic surround signal in particular, although this system has such a feature that a sound field can be obtained on the rear side of a listener or the sound image can be shifted, it has been impossible to obtain such effects as described above without arranging the rear speakers.

Recently, however, a surround signal processing apparatus has been developed such that a stereophonic sound effect similar to the case where the rear speakers are arranged can be obtained on the basis of the sound reproduction through only the front left and right speakers.

In this surround signal processing apparatus, sound image localization signals obtained by transforming the rear channel signals are reproduced through two front speakers arranged at two predetermined positions in front of a listener, in addition to the original two (L- and R-) channel stereophonic signals. Alternatively, two pairs of speakers are arranged in front of a listener; only the original L- and R-channel signals are reproduced through one pair of the speakers; and the sound image localization signals are applied to the other pair of the speakers. On the basis of the sound image localization as described above, even if no rear speakers are arranged behind a listener in practice, it has become possible to reproduce surround sound in such a way that the listener can hear sound as if it came from the rear side of the listener.

In order to obtain the desired sound image localization signal by transforming the rear channel signal as described above, appropriate calculations are executed on the basis of the spatial transfer characteristics between a pair of speakers actually arranged and the left and right side ears of a listener and the spatial transfer characteristics between a speaker arranged only for measurement at one of the two predetermined rear speaker positions (at which sound images are required to be localized) and the left and right side ears of the listener. In other words, filter calculations are executed with the use of convolvers (convolution arithmetic processing circuits).

Here, a prior art surround signal processing apparatus using the sound image localization signals will be described hereinbelow with respect to its configuration and its principle.

FIG. 2 is a conceptual diagram showing the surround signal processing apparatus based upon the sound image localization technique. In the drawing, a surround signal processing apparatus 20 of the four channel type receives two channel stereophonic signals L and R, a center channel signal C for improving the localization of the middle position of the stereophonic sound, and a rear channel signal S for obtaining a surround stereophonic sound effect from the outside. Further, the processing apparatus 20 transforms the rear channel signal S and the center channel signal C into spatial localization signals for localizing sound signals at any desired sound image positions, respectively, in order to realize the surround reproduction in such a way that the reproduced sound can surround a listener LM.

In this sound image processing apparatus 20, it is possible to obtain a surround stereophonic sound effect by reproducing the stereophonic signals L and R and the transformed spatial localization signals through two speakers SP1 and SP2 arranged on the front left and right sides of a listener LM, without arranging two rear left and right speakers SP3 and SP4, a front middle speaker SP5, and a rear middle speaker SP6.

Further, FIG. 3 is an illustration for assistance in explaining a principle that a sound image can be localized at any given spatial position enclosing a listener LM by use of two stereophonic speakers SP1 and SP2. In FIG. 3, the transfer characteristics (the frequency response to an impulse) between the left side speaker SP1 and both left and right ears of a listener LM are denoted by h1L and h1R; and the transfer characteristics between the right side speaker SP2 and both left and right ears of the listener LM are denoted by h2L and h2R; and the transfer characteristics between a speaker assumed to be arranged at an intended localization position x and both left and right ears of the listener LM are denoted by pLx and pRx, respectively. Here, the respective transfer characteristics can be measured by arranging a speaker, a human head (or a dummy head) and two microphones (arranged at both the ear positions thereof). Further, the waveforms of the measured characteristics are processed appropriately.

Here, the case is taken into account where a sound source signal X required to be localized is passed through two signal transforming circuits 21A and 21B (whose transfer characteristics can be represented by cfLx and cfRx), respectively and further reproduced through two speakers SP1 and SP2, respectively. Then, the signals eL and eR received by the left and right ears of the listener LM can, using convolution operation, be expressed as:

$$eL=h1L*cfLx*X+h2L*cfRx*X \quad (11a)$$

$$eR=h1R*cfLx*X+h2R*cfRx*X \quad (11b)$$

On the other hand, when the source signal X is reproduced at the objective localized position, the signals dL and dR received by both left and right ears of the listener LM can be expressed as:

$$dL=pLx*X \quad (12a)$$

$$dR=pRx*X \quad (12b)$$

Now, if the signals reproduced by the speakers SP1 and SP2 and then received by both ears of the listener LM match the signals reproduced when the source signal X is reproduced at the objective localization position x, it is possible for the listener LM to recognize the sound image as if a speaker were arranged at the objective localization position x.

That is, the following formulae can be obtained by eliminating the source signal X on the basis of the conditions eL=dL and eR=dR and in accordance with the formulae (11a), (11b), (12a) and (12b):

$$h1L*cfLx+h2L*cfRx=pLx \quad (13a)$$

$$h1R*cfLx+h2R*cfRx=pRx \quad (13b)$$

Further, cfLx and cfRx can be obtained in accordance with the formulae (13a) and (13b) as:

$$cfLx=(h2R*pLx-h2L*pRx)*(1H) \quad (14a)$$

$$cfRx=(-h1R*pLx+h1L*pRx)*(1/H) \quad (14b)$$

$$\text{where } H=h1L*h2R-h2L*h1R \quad (14c)$$

Accordingly, when the signal required to be localized is processed by the signal transforming circuits 21A and 21B (referred to as localization filters for a position x) provided with the transfer characteristics cfLx and cfRx calculated in accordance with the formulae (14a) to (14c) respectively, it is possible to localize a sound image at an objective localization position x.

In other words, a sound image can be localized at an objective position x by processing the surround signal through a pair of localization filters determined by setting a rear speaker arrangement position to a sound image localization position x, and further by reproducing the filtered sound source signal through the two front speakers SP1 and SP2, respectively. In practice, however, a surround signal processing apparatus has been so far constructed by combining a plurality of pairs of localization filters, as shown in FIG. 4 or 5, respectively. In more detail, FIG. 4 shows a prior art surround signal processing apparatus which can process the sound image localization in such a way that two rear channel signals SL and SR can be reproduced at two symmetrical rear left and right positions of a listener LM, on the basis of two channel stereophonic signals L and R, a single channel center signal C, and two rear channel surround (rear) signals SL and SR all outputted by a surround decoder SD.

In this processing apparatus, a pair of the localizing filters 21A and 21B is provided for each of the two rear channel signals SL and SR, and two sound image are localized at two positions of the two rear speakers SP3 and SP4, as shown in FIG. 2. That is, the signals obtained by addition of the signals L, R and C and the sound image localization processed signals are reproduced by a pair of the two front speakers SP1 and SP2, respectively. Therefore, in this processing apparatus, the sound image localization processing is made by use of 4 filters in total for two surround (rear) channel signals SL and SR.

Further, although not shown, there exists another processing apparatus such that the sound image localization processing can be made for the front channel signals L and R. In this processing apparatus, 8 filters are necessary in total. Furthermore, there exists another processing apparatus such that the sound image localization processing is executed for the front channel signals L and R and further for the center signal C. In this case, however, 10 filters in total are required.

On the other hand, FIG. 5 shows a prior art surround signal processing apparatus which can cope with a surround reproduction system using a monophonic (single system) rear surround signal. In this processing apparatus, a pair of localization filters (21A and 21B) for one channel are provided, and the surround signal S can be localized at the position of the speaker SP6, as shown in FIG. 2, by use of two filters in total.

In the above-mentioned prior art surround signal processing apparatus as shown in FIG. 4, however, since two pairs of the sound image localization processing filters (21A, 21B; 21A, 21B) are necessary for the rear stereophonic signals; that is, since 4 filters are necessary in total, the hardware scale inevitably increases, thus causing a problem in that this processing apparatus cannot be used for the ordinary home appliances such as television sets.

Further, in the case of the surround signal processing apparatus using the monophonic (one system) rear surround signal as shown in FIG. 5, since a sound image is localized at only one rear position, it is difficult to manifest the sound field behind the listener LM sufficiently and or manifest the sound image movement articulately, thus raising a problem in that a sufficient surround effect cannot be obtained.

SUMMARY OF THE INVENTION

Accordingly, it is the object of the present invention to provide a surround signal processing apparatus which can localize sound images of rear surround signals at predetermined localization positions (at a pair of virtual rear speaker arrangement positions) with respect to a listener.

To achieve the above-mentioned object, the present invention provides a surround signal processing apparatus for reproducing an inputted rear surround signal, together with two-channel front stereophonic signals, through a pair of transducers arranged in front of and at substantially right-and-left symmetrical positions with respect to a listener, so as to localize sound images of the reproduced rear surround signals at predetermined positions relative to the listener, which comprises: filter means for processing the inputted rear surround signal in accordance with predetermined transfer characteristics provided therein; inverting means for inverting polarity of the signal processed by said filter means to obtain an inversion signal thereof; first adding means for adding the signal processed by said filter means and one of the stereophonic signals, to output the obtained addition signal to one of the pair of the transducers; and second adding means for adding the inversion signal inverted by said inverting means and the other of the stereophonic signals, to output the obtained addition signal to the other of the pair of the transducers; and wherein: the transfer characteristics of said filter means are set as follows: (F−K)/(S−A), where S denotes transfer characteristics between one of the speakers and one of the listener's ears positioned on the same side as the transducer, respectively; A denotes transfer characteristics between one of the transducers and one of the listener's ears positioned on an opposite side to the transducer, respectively; F denotes transfer characteristics between one of the two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes a reverse convolution calculation.

It is preferable that the apparatus further comprises: storing means for storing a plurality of transfer characteristics according to a plurality of sound image localization positions, respectively; and setting means for reading the transfer characteristics according to at least one desired sound image localization position from a plurality of stored transfer characteristics and for setting the read transfer characteristics to said filter means.

Further, the present invention provides a surround signal processing apparatus for reproducing an inputted rear surround signal, together with two-channel front stereophonic signals, through a pair of transducers arranged in front of and at substantially right-and-left symmetrical position with respect to a listener, so as to localize sound images of the reproduced rear surround signals at predetermined positions relative to the listener, which comprises: first signal forming means for forming first and second independent signals on the basis of the inputted rear surround signal; second signal forming means for forming a first addition signal and a first subtraction signal, respectively on the basis of the first and second independent signals; first filter means for processing the first addition signal in accordance with first transfer characteristics P provided therein; second filter means for processing the first subtraction signal in accordance with second transfer characteristics N provided therein; third signal forming means for forming a second addition signal and a second subtraction signal, respectively on the basis of signals processed by said first and second filter means; first adding means for adding the second addition signal and one of the stereophonic signals, to output the obtained addition signal to one of the pair of the transducers; and second adding means for adding the second subtraction signal and the other of the stereophonic signals, to output the obtained addition signal to the other of the pair of the transducers; and wherein: the transfer characteristics P and N of said first and second filter means are set, respectively as follows: P=(F+K)/(S+A), N=(F−K)/(S−A), where S denotes transfer characteristics between one of the transducers and one of the listener's ears positioned on the same side as the transducer, respectively; A denotes transfer characteristics between one of the transducers and one of the listener's ears positioned on an opposite side to the transducer, respectively; F denotes transfer characteristics between one of the two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes reverse convolution calculation.

Further, the present invention provides an audio video reproducing apparatus having a display unit for picture reproduction and a pair of speakers arranged on both sides of the display unit to reproduce audio signals, for reproducing an inputted rear surround signal, together with two-channel front stereophonic signals, through the pair of speakers, so as to localize sound images of the reproduced rear surround signals at predetermined positions relative to a viewer, which comprises: filter means for processing the inputted rear surround signal in accordance with predetermined transfer characteristics provided therein; inverting means for inverting polarity of the signal processed by said filter means to obtain an inversion signal thereof; first adding means for adding the signal processed by said filter means and one of the stereophonic signals, to output the obtained addition signal to one of the pair of the speakers; and second adding means for adding the inversion signal inverted by said inverting means and the other of the stereophonic signals, to output the obtained addition signal to the other of the pair of the speakers; and wherein: the transfer characteristics of said filter means are set as follows: (F−K)/(S−A), where S denotes transfer characteristics between one of the speakers and one of the listener's ears positioned on the same side as the speaker, respectively; A denotes transfer characteristics between one of the speakers and one of the listener's ears positioned on an opposite side to the speaker, respectively; F denotes transfer characteristics between one of the two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes a reverse convolution calculation.

Further, the present invention provides an audio video reproducing apparatus having a display unit for picture reproduction and a pair of speakers arranged on both sides of the display unit to reproduce audio signals, for reproducing an inputted rear surround signal, together with two-channel front stereophonic signals, through the pair of speakers, so as to localize sound images of the reproduced rear surround signals at predetermined positions relative to a viewer, which comprises: first signal forming means for forming first and second independent signals on the basis of the inputted rear surround signal; second signal forming means for forming a first addition signal and a first subtraction signal, respectively on the basis of the first and second signals; first filter means for processing the first addition signal in accordance with first transfer characteristics P provided therein; second filter means for processing the first subtraction signal in accordance with second transfer characteristics N provided therein; third signal forming means for forming a second addition signal and a second subtraction signal, respectively on the basis of signals processed by said first and second filter means; first adding means for adding the second addition signal and one of the stereophonic signals, to output the obtained addition signal to one of the pair of speakers; and second adding means for adding the second subtraction signal and the other of the stereophonic signals, to output the obtained addition signal to the other of the pair of the speakers; and wherein: the transfer characteristics P and N of said first and second filter means are set, respectively as follows: P=(F+K)/(S+A), N=(F−K)/(S−A), where S denotes transfer characteristics between one of the speakers and one of the listener's ears positioned on the same side as the speaker, respectively; A denotes transfer characteristics between one of the speakers and one of the listener's ears positioned on an opposite side to the speaker, respectively; F denotes transfer characteristics between one of the two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes reverse convolution calculation.

Further, it is preferable that the apparatus further comprises: storing means for storing a plurality of transfer characteristics according to a plurality of sound image localization positions, respectively; and setting means for reading the transfer characteristics according to at least one desired sound image localization position from a plurality of stored transfer characteristics and for setting the read transfer characteristics to said first and second filter means.

Further, it is possible to reproduce a center surround signal, in addition to the rear surround signals and the front stereophonic signals, through a pair of the speakers.

Further, the present invention provides an audio video reproducing apparatus having a display unit for picture reproduction, a pair of speakers arranged on both sides of the display unit to reproduce audio signals, and a surround signal processor for localizing sound images of inputted front stereophonic signals at predetermined positions relative to a viewer, which comprises: first signal forming means for forming a first addition signal and a first subtraction signal on the basis of the inputted stereophonic signals; first filter means for processing the first addition signal in accordance with first transfer characteristics P provided therein; second filter means for processing the first subtraction signal in accordance with second transfer characteristics N provided therein; and outputting means for forming a second addition signal and a second subtraction signal on the basis of the signals processed by said first and second filter means, respectively and for outputting the formed signals to the pair of speakers, respectively, and wherein: the transfer characteristics P and N of said first and second filter means are set, respectively as follows: P=(F+K)/(S+A), N=(F−K)/(S−A), where S denotes transfer characteristics between one of the speakers and one of the listener's ears positioned on the same side as the speaker, respectively; A denotes transfer characteristics between one of the speakers and one of the listener's ears positioned on an opposite side to the speaker, respectively; F denotes transfer characteristics between one of the two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes a reverse convolution calculation, and wherein: sound images of the front stereophonic signals can be localized at positions remote from both sides of or on the display unit.

Further, it is preferable that the apparatus further comprises: storing means for storing a plurality of transfer characteristics according to a plurality of sound image localization positions, respectively; and setting means for reading the transfer characteristics according to at least one desired sound image localization position from a plurality of stored transfer characteristics and for setting the read transfer characteristics to said first and second filter means.

Further, it is preferable to localize a sound image of a center surround signal on the display unit.

Further, the present invention provides a surround signal processing apparatus for reproducing surround signals through a pair of transducers and for localizing sound images of the surround signals at positions different from those at which the pair of transducers are arranged, which comprises: first signal forming means for forming a subtraction signal on the basis of inputted two-channel stereophonic signals; filter means for processing the subtraction signal in accordance with predetermined transfer characteristics provided therein; second signal forming means for forming an inversion signal by inverting polarity of the signal processed by said filter means; first adding means for adding the signal processed by said filter means and one of the stereophonic signals and outputting the added signal to one of the pair of the transducers; and second adding means for adding the inversion signal obtained by said second forming means and the other of the stereophonic signals and outputting the added signal to the other of the pair of the transducers; and wherein: the transfer characteristics of said filter means are set as follows: (F−K)/(S−A), where S denotes transfer characteristics between one of the transducers and one of the listener's ears positioned on the same side as the transducer, respectively; A denotes transfer characteristics between one of the transducers and one of the listener's ears positioned on an opposite side to the transducer, respectively; F denotes transfer characteristics between one of the two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes a reverse convolution calculation.

Further, it is preferable that the apparatus further comprises: storing means for storing a plurality of transfer characteristics according to a plurality of sound image localization positions, respectively; and setting means for reading the transfer characteristics according to at least one desired sound image localization position from a plurality of stored transfer characteristics and for setting the read transfer characteristics to said filter means.

Further, the present invention provides an audio video reproducing apparatus having means to reproduce picture and audio signals, a pair of loud speakers to reproduce the audio signal arranged on both sides of a display unit to reproduce the picture signal and a surround signal processor for reproducing an inputted rear surround signal, together with two-channel front stereophonic signals, through the pair of loud speakers, so as to localize sound images of the reproducing surround signals at positions different from the pair of loud speakers, which comprises: adjusting means for adjusting relative amplitude characteristics of the two-channel front stereophonic signals and the rear surround signal; first signal forming means for forming a first addition signal and a first subtraction signal on the basis of the adjusted rear surround signals; first filter means for processing the first addition signal in accordance with first transfer characteristics P provided therein; second filter means for processing the first subtraction signal in accordance with second transfer characteristics N provided therein; second signal forming means for forming a second addition signal and a second subtraction signal on the basis of the signals processed by said first and second filter means; first adding means for adding the second addition signal and one of the stereophonic signals and for outputting the obtained addition signal to one of the pair of speakers; and second adding means for adding the second subtraction signal and the other of the stereophonic signals and for outputting the obtained addition signal to the other of the pair of loud speakers; and wherein: the transfer characteristics P and N of said first and second filter means are set, respectively as follows: $P=(F+K)/(S+A)$, $N=(F-K)/(S-A)$, where S denotes transfer characteristics between one of the speakers and one of the listener's ears positioned on the same side as the speaker, respectively; A denotes transfer characteristics between one of the speakers and one of the listener's ears positioned on an opposite side to the speaker, respectively; F denotes transfer characteristics between one of the two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes a reverse convolution calculation.

Further, it is preferable that the apparatus further comprises: storing means for storing a plurality of transfer characteristics according to a plurality of sound image localization positions, respectively; and setting means for reading the transfer characteristics according to at least one desired sound image localization position from a plurality of stored transfer characteristics and for setting the read transfer characteristics to said first and second filter means.

DETAILED DESCRIPTION OF THE EMBODIMENTS

Embodiments of the surround signal processing apparatus according to the present invention will be described in detail hereinbelow with the attached drawings.

[Embodiment 1]

Figure 6:
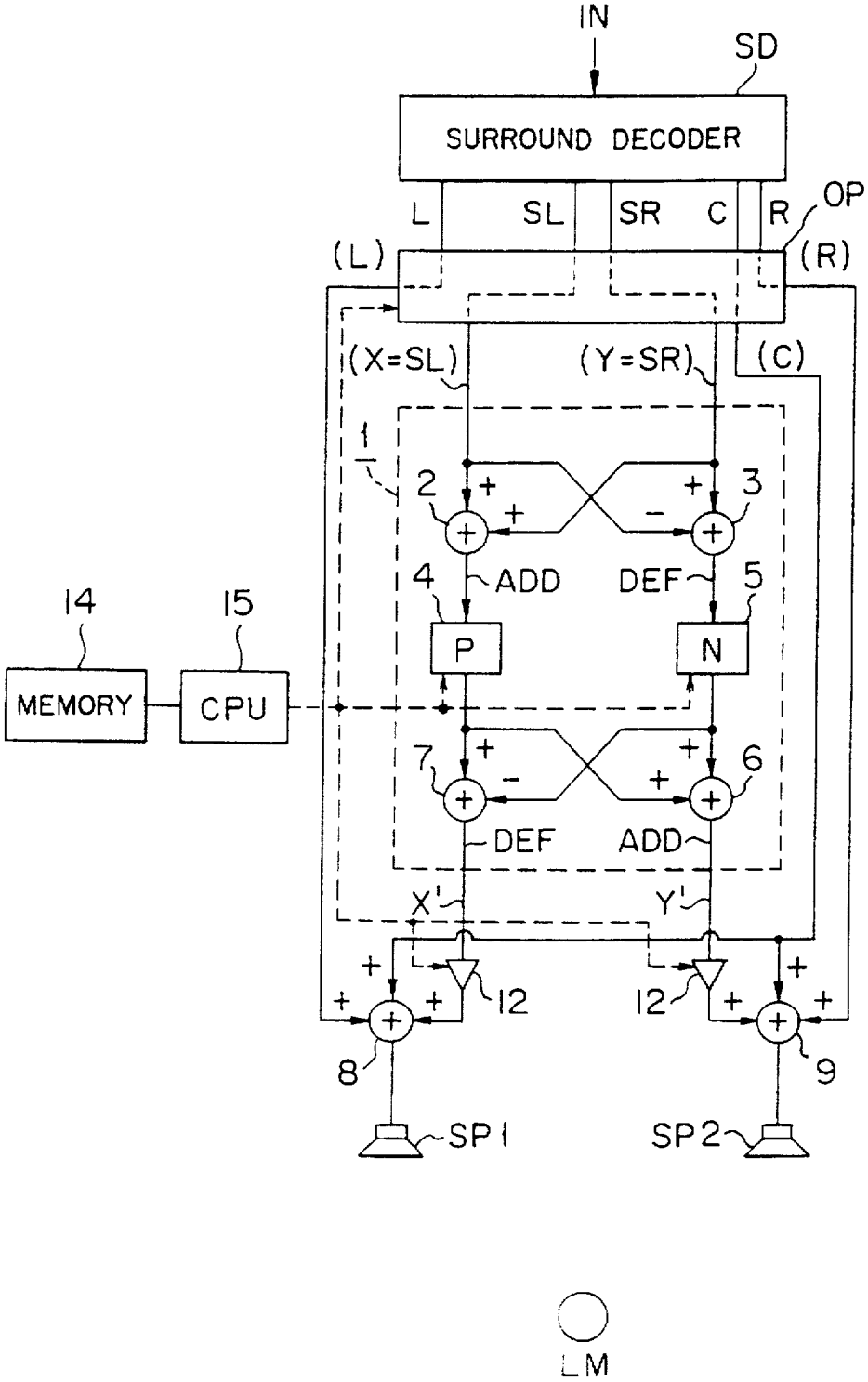
FIG. 6 is a block diagram showing a first embodiment of the surround signal processing apparatus according to the present invention.

FIG. 6 shows a first embodiment of the surround signal processing apparatus according to the present invention. As shown, the processing apparatus is composed of a surround processing circuit (surround decoder) SD, an additional signal processing circuit OP, and a sound image localization processing circuit 1. Here, the sound image localization processing circuit 1 is an essential portion of the present invention, which is composed of a first adder 2, a first subtracter 3, a first filter 4, a second filter 5, a second adder 6, a second subtracter 7 and two amplitude adjusters 12.

The surround processing circuit SD is a well-known decoder for demodulating signals inputted thereto to generate the front stereophonic signals L and R, the center signal C, and the rear stereophonic signals SL and SR.

Further, the additional signal processing circuit OP includes circuits for processing these signals L, R, C, SL and SR generated by the surround processing circuit SD, for amplitude adjustment, reverberation processing, reflected sound addition, etc., which are incorporated as occasion demands. Information related to these amplitude adjustment, reverberation processing, reflected sound addition, etc., is stored in a memory 14 and is applied to the additional signal processing circuit OP via CPU 15 to conduct a specific processing. The gain characteristics (relative amplitude characteristics) of the amplitude adjuster 12 is also stored in the memory 14 and applied to the adjusters 12 via CPU 15.

Further, the first filter 4 and the second filter 5 are both convolution calculating means (e.g., digital signal processor) such as convolvers provided with P and N transfer characteristics (to be described later in further detail), respectively.

The rear stereophonic signals SL and SR applied by the surround processing circuit SD and the additional signal processing circuit OP are inputted to the sound image localization processing circuit 1.

Here, a first addition signal (SL+SR) of both and a first subtraction signal (SL−SR) between both are generated by the first adder 2 and the first subtracter 3, respectively. The generated first addition signal is processed by the first filter 4, and the generated first subtraction signal is processed by the second filter 5.

Further, a second addition signal (P+N) of both and a second subtraction signal (P−N) between both are generated by the second adder 6 and the second subtracter 7 as processed output signals Y' and X', respectively.

The processed output signals Y' and X' are inputted to the amplitude adjusters 12, respectively, in which the amplitudes of the processed output signals Y' and X' are adjusted with respect to the front stereophonic signals L and R and the center signal C.

Further, a third adder 8 adds the adjusted processed output signal X', the front stereophonic signal L and the center signal C. On the other hand, a fourth adder 9 adds the adjusted processed output signal Y', the front stereophonic signal R and the center signal C. A pair of added stereophonic signals as described above are reproduced through a pair of transducers (a pair of loud speakers SP1 and SP2, in this embodiment), so that a listener LM can hear the reproduced sound. Here, the two loud speakers SP1 and SP2 are arranged in front of the listener LM at two symmetrical positions with respect to him or her.

In the above-mentioned description, the transfer characteristics P and N of the first and second filters 4 and 5 are expressed as:

$$P=(F+K)/(S+A)$$

$$N=(F-K)/(S-A)$$

Figure 7:
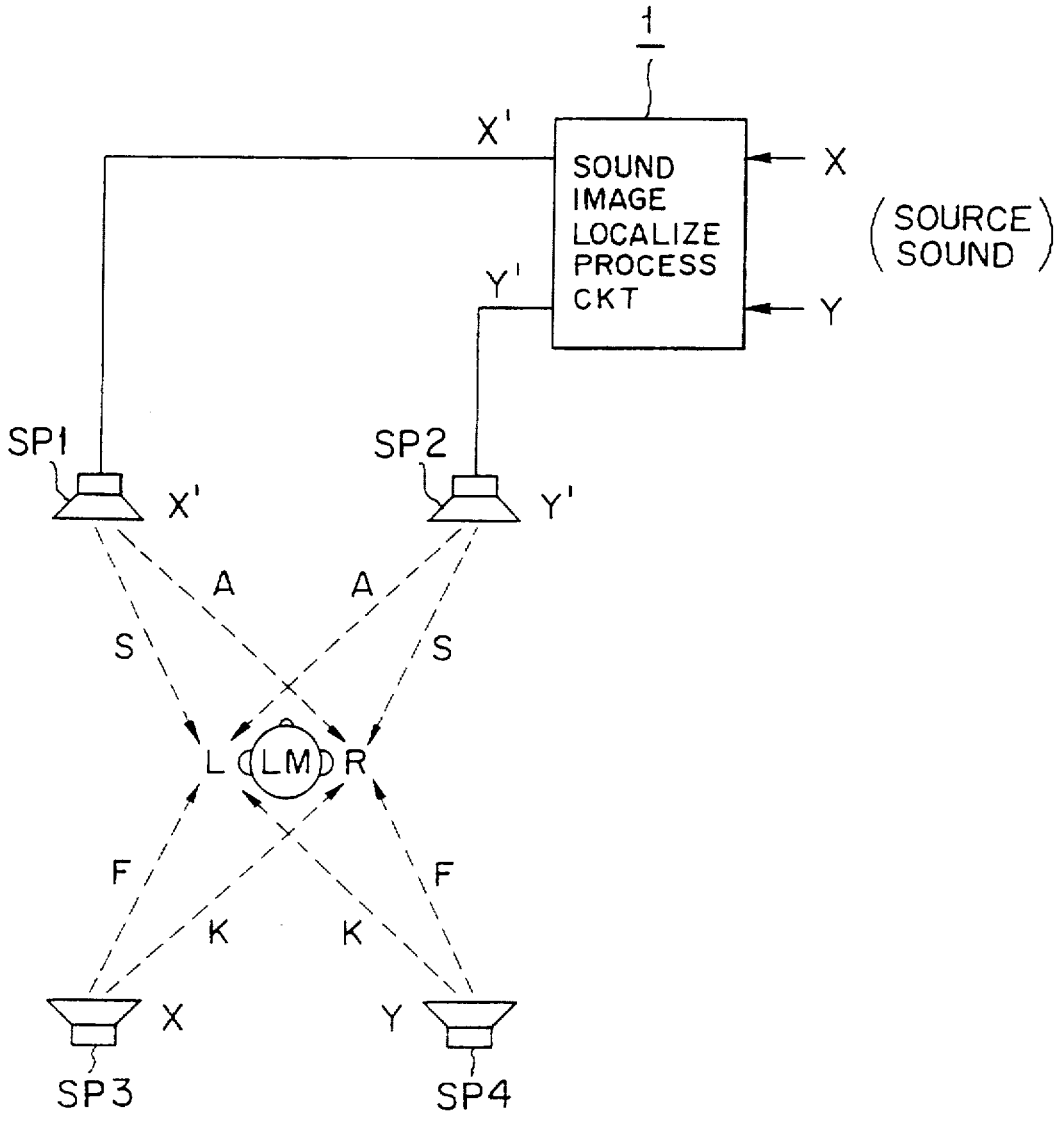
FIG. 7 is an illustration for assistance in explaining the sound image localization processing by the surround signal processing apparatus shown in FIG. 6.

Here, as depicted in FIG. 7, S denotes the transfer characteristics between each of a pair of loud speakers SP1 and SP2 and each listener's (LM) ear positioned on the same side as each speaker; A denotes the transfer characteristics between each of the pair of loud speakers SP1 and SP2 and each listener's ear positioned on the opposite side to each speaker; F denotes the transfer characteristics between each of a pair of positions at which the sound images of surround signals are required to be localized (a pair of positions at which two virtual rear loud speakers SP3 and SP4 are arranged in symmetry with respect to the listener LM) and each listener's ear positioned on the same side as each position; and K denotes the transfer characteristics between each of the pair of positions at which the sound images of surround signals are required to be localized and each listener's ear positioned on the opposite side to each position.

Further, in the above-mentioned transfer characteristics P and N, the operator [+] designates an addition calculation of the two transfer characteristics; the operator [−] designates a subtraction of the two transfer characteristics; and the operator [/] designates a reverse convolution calculation, respectively. Further, in the above description, the same side indicates that the ear (e.g., the right side ear) and the speaker (e.g., the right side speaker) are positioned on the same side, and the opposite side indicates that the ear (e.g., the right side ear) and the speaker (e.g., the left side speaker) are positioned on the opposite side to each other.

Further, these transfer characteristics can be obtained as follows: actual speakers are arranged at predetermined rear positions in a no-sound space; two microphones are arranged at both ear positions of a human head (or a dummy head); the sound signals reproduced by the speakers are measured by the microphones; and the waveforms of the obtained measurement data are further processed appropriately.

Figure 8:
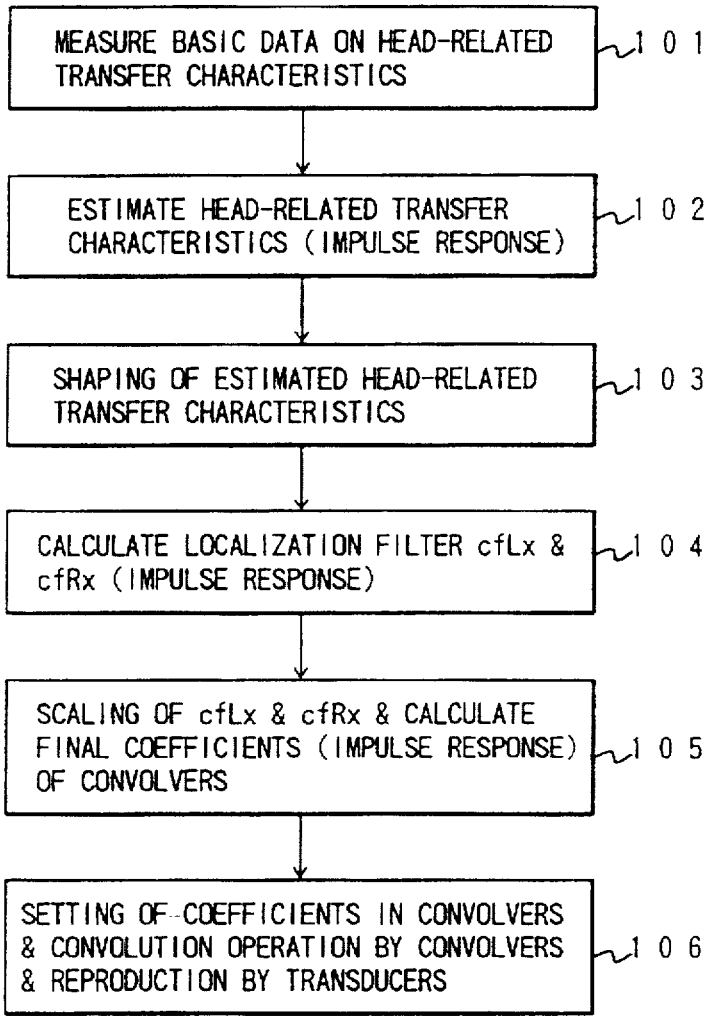
FIG. 8 is a flowchart for assistance in explaining the sound image localization measuring method.

This measuring method will be described in detail by referring to FIG. 8. Incidentally, FIG. 8 is a flowchart for illustrating steps of this method.

(1). Measurement of Basic Data on Head Related Transfer Characteristics (thus HRTF) (step 101)

Figure 9:
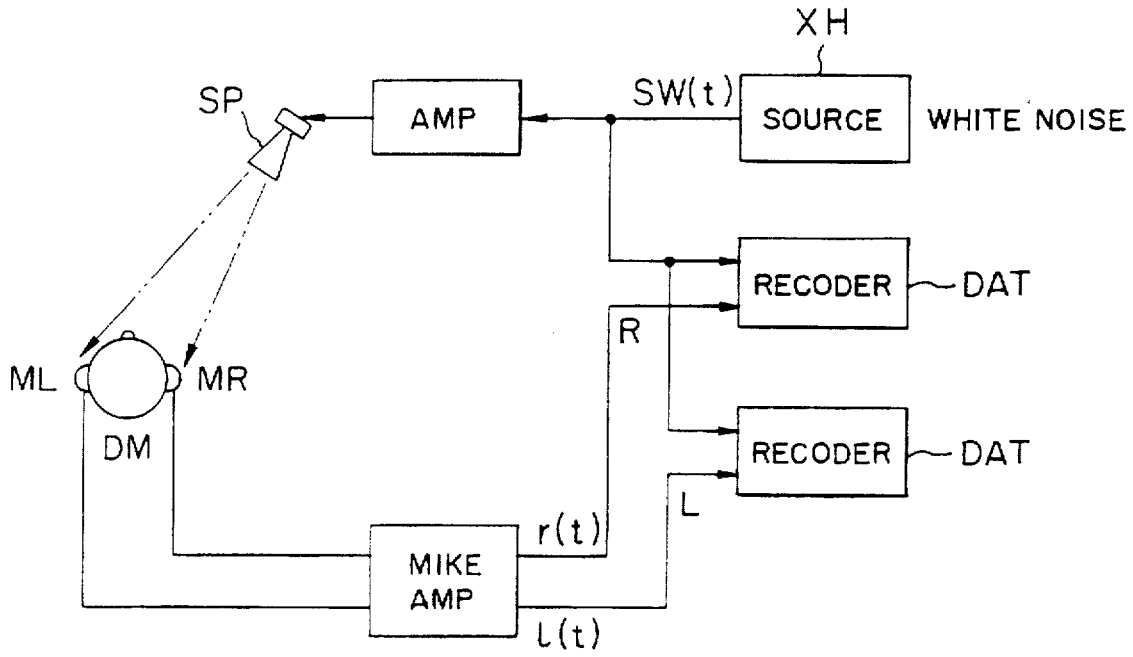
FIG. 9 is a block diagram showing a sound image localization measuring system.

The HRTF measurement will be explained with reference to FIG. 9 which shows a block diagram of a HRTF measuring system. A pair of microphones ML and MR are set at the positions of the ears of a human head (or a dummy head) DM. From a speaker SP these microphones receive sounds to be measured. Further, a source sound sw(t) (namely, reference data) and the sounds l(t) and r(t) to be measured (namely, data to be measured) L and R are recorded by recorders DAT in synchronization with one another.

Incidentally, impulse sounds and noises such as white noise may be used as the source sound sw(t). Especially, it is noted the from the statistical point of view, that white noise is preferable for improving the signal-to-noise ratio (S/N) because of the fact that the white noise is a continuous sound and that the energy distribution of the white noise is constant over what is called an audio frequency band.

Additionally, the speaker SP is placed at a position (hereunder sometimes referred to as a measurement position) corresponding to a plurality of central angles θ (incidentally, the position of the human head (or dummy head) DM is the center and the central angle corresponding to just in front of the human head is set to be the 0 degree location). Furthermore, the sounds radiated from these speakers are recorded continuously for a predetermined duration. Thus, basic data on the head related transfer characteristics are collected and measured.

(2). Estimation of Head Related Transfer Characteristics (Impulse Response) (step 102)

In this step, the source sound sw(t) and the sounds l(t) and r(t) to be measured recorded in step 101 in synchronization with one another are processed by a workstation (not shown).

Here, let Sw(ω), Y(ω) and IR(ω)) denote the source sound in frequency-domain representation (namely, the reference data), the sound to be measured, which is in frequency-domain representation, (namely, the data to be measured) and the head-related transfer characteristics in frequency-domain representation obtained at the measurement positions, respectively. Further, the relation among input and output data is represented by the following equation:

$$Y(\omega)=IR(\omega)\cdot Sw(\omega) \tag{15}$$

Thus, IR(ω) is obtained as follows:

$$IR(\omega)=Y(\omega)/Sw(\omega) \tag{16}$$

Thus, the reference data sw(t) and the measured data l(t) and r(t) obtained in step 101 are extracted as the reference data Sw(ω) and the measured data Y(ω) by using synchronized windows and performing FFT thereon to expand the extracted data into finite Fourier series with respect to discrete frequencies. Finally, the head related transfer characteristics IR(ω) composed of a pair of left and right transfer characteristics corresponding to each sound image location are calculated and estimated from the equation (16).

In this manner, the head related transfer characteristics respectively corresponding to 12 positions set every 30 degrees are obtained. Incidentally, hereinafter, the head related transfer characteristics composed of a pair of left and right transfer characteristics will be referred to simply as head related transfer characteristics (namely, an impulse response). Further, the left and right transfer characteristics will not be referred to individually. Moreover, the head related transfer characteristics in time-domain representation will be denoted by ir(t) and those in frequency-domain representation will be denoted by IR(ω).

Further, the time-base response (namely, the impulse response) ir(t) (namely, a first impulse response) is obtained by performing an inverse FFT on the computed frequency responses IR(ω).

Incidentally, where the head related transfer characteristics are estimated in this way, it is preferable for improving the precision of IR(ω) (namely, improving S/N ration) to compute the frequency responses IR(ω) respectively corresponding to hundreds of windows which are different in time from one another, and to then average the computed frequency responses IR(ω).

(3). Shaping of Head Related Transfer Characteristics (Impulse Response) ir(t) (step 103)

In this step, the impulse response ir(t) obtained in step 102 is shaped. First, the first impulse response ir(t) obtained in step 102 is expanded with respect to discrete frequencies by performing FFT over what is called an audio spectrum.

Thus, the frequency response IR(ω) is obtained. Moreover, components of an unnecessary band (for instance, large dips may occur in a high frequency band but such a band is unnecessary for the sound image localization) is eliminated from the frequency response IR(ω) by a band-pass filter (BPF) which has a passband of 50 hertz (Hz) to 16 kilo-hertz (kHz). As the result of such a band limitation, unnecessary peaks and dips existing on the frequency axis or base are removed. Thus, coefficients unnecessary for the localization filters are not generated. Consequently, the convergency can be improved and the number of coefficients of the localization filter can be reduced.

Then, an inverse FFT is performed on the band-limited IR(ω) to obtain the impulse response ir(t). Subsequently, what is called a window processing is performed on ir(t) (namely, the impulse response) on the time base or axis by using an extraction window (for instance, a window represented by a cosine function). (Thus, a second impulse response ir(t) is obtained.) As a result of the window processing, only an effective portion of the impulse response can be extracted and thus the length (namely, the region of support) thereof becomes short. Consequently, the convergency of the localization filter becomes improved. Moreover, the sound quality does not become deteriorated.

Incidentally, it is not always necessary to generate the first impulse response ir(t). Namely, the FFT transform and the inverse FFT transform to be performed before the generation of the first impulse response ir(t) is effected may be omitted. However, the first impulse response ir(t) can be utilized for monitoring and can be reserved as the proto-type of the coefficients. For example, the effects of the BPF can be confirmed on the time axis by comparing the first impulse response ir(t) with the second impulse response ir(t). Moreover, it can be also confirmed whether the filtering performed according to the coefficients does not converge but oscillates. Furthermore, the first impulse response ir(t) can be preserved as basic transfer characteristics to be used for obtaining the head related transfer characteristics at the intermediate position by computation instead of actual observation.

(4). Calculation of Transfer Characteristics cfLx(t) and cfRx(t) of Localization Filters (step 104)

The time-domain transfer characteristics cfLx(t) and cfRx(t) of a pair of localization filters, which are necessary for localizing a sound image at a target position x, are given by the equations (14a) and (14b) as above described. Namely, $$cfLx(t)=\{h2R(t)*pLx(t)-h2L(t)*pRx(t)\}*g(t) \quad (14a')$$

$$cfRx(t)=\{(-h1R(t)*pLx(t)+h1L(t)*pRx(t)\}*g(t) \quad (14b')$$

where g(t) is an inverse Fourier transform of $G(\omega)=1/\{H1L(\omega)\cdot H2R(\omega)-H2L(\omega)\}$.

Here, it is supposed that speakers are placed in the directions corresponding to azimuth angles of 30 degrees leftwardly and rightwardly from the very front of the dummy head (corresponding to θ=330 degrees and θ=30 degrees, respectively) (namely, 30 degrees counterclockwise and clockwise from the central vertical radius) and that the target positions corresponding to θ are set every 30 degrees. Hereinafter, it will be described how the transfer characteristics cfLx(t) and cfRx(t) of the localization filters are obtained from the head related transfer characteristics composed of the pair of the left and right transfer characteristics, namely, the pair of the left and right second impulse responses (ir(t)), which are obtained in steps 101 to 103 correspondingly to angles θ and are shaped.

Firstly, the second impulse response ir(t) corresponding to θ=330 degrees is substituted for the head-related transfer characteristics h1L(t) and h1R(t) of the equations (14a ') and (14b'). Further, the second impulse response ir(t) corresponding to θ=30 degrees is substituted for the head-related transfer characteristics h2L(t) and h2R(t) of the equations (14a') and (14b'). Moreover, the second impulse response ir(t) corresponding to the target localization position x is substituted for the head-related transfer characteristics pLx(t) and pRx(t) of the equations (14a') and (14b').

On the other hands the function g(t) of time t is an inverse Fourier transform of G(θ) which is a kind of inverse filter of the term {H1L((ω)·H2R(ω)−H2L(ω)·)H1R(ω)}. Further, the function g(t) does not depend on the target sound image position or location x but depends on the positions (namely, θ=330 degrees and θ=30 degrees) at which the speakers are placed. This time-dependent function g(t) can be relatively easily obtained from the head-related transfer characteristics h1L(t), h1R(t), h2L(t) and h2R(t) by using a method of least squares. This method is described in detail in, for instance, the article entitled "Inverse filter design program based on least square criterion", Journal of Acoustical Society of Japan, 43[4], pp. 267 to 276, 1987.

The time-dependent function g(t) obtained by using the method of least squares as above described is substituted for the equations (14a') and (14b'). Then, the pair of the transfer characteristics cfLx(t) and cfRx(t) for localizing a sound image at each sound image location are obtained not adaptively but uniquely as a time-base or time-domain impulse response by performing the convolution operations according to the equations (14a') and (14b'). Furthermore, the coefficients (namely, the sequence of the coefficients) are used as the coefficient data.

As described above, the transfer characteristics cfLx(t) and cfRx(t) of an entire space (360 degrees) are obtained correspondingly to the target sound image locations or positions established every 30 degrees over a wide space (namely, the entire space), the corresponding azimuth angles of which are within the range from the very front of the human head to 90 degrees clockwise and counterclockwise (incidentally, the desired location of the sound image is included in such a range) and may be beyond such a range. Incidentally, hereinafter, it is assumed that the characters cfLx(t) and cfRx(t) designate the transfer characteristics (namely, the impulse response) of the localization filters, as well as the coefficients (namely, the sequence of the coefficients).

As is apparent from the equations (14a') and (14b'), it is very important for reducing the number of the coefficients (namely, the number of taps) of the localization filters (the corresponding transfer characteristics cfLx(t) and cfRx(t)) to "shorten" (namely, reduce what is called the effective length of) the head-related transfer characteristics h1L(t), h1R(t), h2L(t), h2R(t), pRx(t) and pLx(t). For this purpose, various types of processing (for instance, a window processing and a shaping processing) are effected in steps 101 to 103, as described above, to "shorten" the head-related transfer characteristics (namely, the impulse response) ir(t) to be substituted for h1L(t), . . . , and h2R(t).

Further, the transfer characteristics (namely, the coefficients) of the localization filters may be obtained by performing FFT on the transfer characteristics (namely, the coefficients) cfLx(t) and cfRx(t) calculated as described above to find the frequency response, and then performing a moving average processing on the frequency response using a constant predetermined shifting width and finally effecting an inverse FFT of the result of the moving average processing. The unnecessary peaks and dips can be removed as the result of the moving average processing. Thus, the convergence of the time response to be realized can be quickened and the size of the localization filter can be reduced.

(5). Scaling of Coefficients of Localization Filters Corresponding to Each Sound Image Location (step 105)

One of the spectral distributions of the source sounds of the sound source, on which the sound image localization processing is actually effected by using the convolvers (namely, the localization filters), is like that of pink noise. In case of another spectral distribution of the source sounds, the intensity level gradually decreases in a high (namely, long) length region. In any case, the source sound of the sound source is different from single tone. Therefore, when the convolution operation (or integration) is effected, an overflow may occur. As a result, a distortion in signal may occur.

Thus, to prevent an occurrence of the overflow, the coefficient having a maximum gain is first detected among the coefficients cfLx(t) and cfRx(t) of the localization filters. Then, the scaling of all of the coefficients is effected in such a manner that no overflow occurs when the convolution of the coefficient having the maximum gain and a white noise of 0 dB is performed.

Namely, the sum of squares of each set of the coefficients cfLx(t) and cfRx(t) of the localization filters is first obtained. Then, the localization filter having a maximum sum of the squares of each set of the coefficients thereof is found. Further, the scaling of the coefficients is performed such that no overflow occurs in the found localization filter having the maximum sum. Incidentally, the same scaling ratio is used for the scaling of the coefficients of all of the localization filters in order not to lose the balance of the localization filters corresponding to sound image locations, respectively.

As the result of performing the scaling processing in this way, coefficient data (namely, data on the groups of the coefficients of the impulse response) to be finally supplied to the localization filters (namely, convolvers to be described later) as the coefficients (namely, the sequence of the coefficients) are obtained. In the case of this example, 12 sets or groups of the coefficients cfLx(t) and cfRx(t), by which the sound image can be localized at the positions set at angular intervals of 30 degrees, are obtained.

(6). Convolution Operation And Reproduction of Sound Signal Obtained from Sound Source (step 106)

Namely, a time-base convolution operation is performed on the signals sent from the sound source s(t). Then, the signals obtained as the result of the convolution operation are reproduced from the spaced-apart speakers sp1 and sp2.

In the surround signal processing apparatus constructed as described above, when the two rear stereophonic signals SL and SR (surround signals) applied by the surround processing circuit SD are processed and then reproduced through a pair of speakers SP1 and SP2, the reproduced sound transmitted from the left stereophonic speaker SP1 to the right ear of the listener LM is canceled by the reproduced sound transmitted from the right speaker SP2 to the left ear of the same listener LM; that is, the crosstalk between the two sound signals can be canceled by each other.

Therefore, the listener LM can hear only the sound reproduced and transmitted from the left speaker SP1 to only his left ear and only the sound reproduced and transmitted from the right speaker SP2 to only his right ear. In addition, since the rear surround signals SL and SR are processed appropriately according to the transfer characteristics F and K of the two filters 4 and 5, it is possible to localize the sound images at the two required sound image localization positions (at SP3 and SP4), respectively.

Here, the image localization of the present invention will be discussed in further detail in comparison with that of the prior art.

On the basis of the principle illustration (FIG. 3) and the formulae (14a) to (14c), the processing for localizing two different sound images at two symmetrical positions with respect to a listener will be taken into consideration.

Figure 1A:
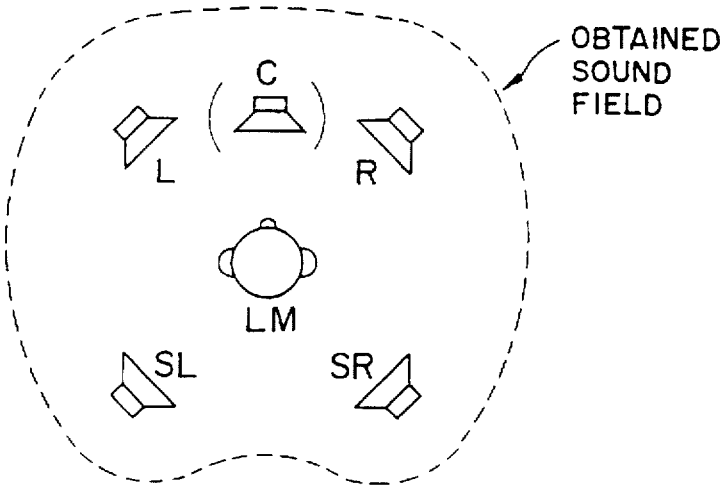
FIGS. 1A and 1B are illustrations for assistance in explaining the general surround system.
Figure 1B:
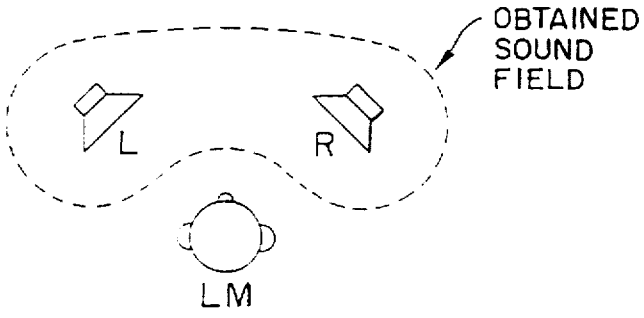
Figure 2:
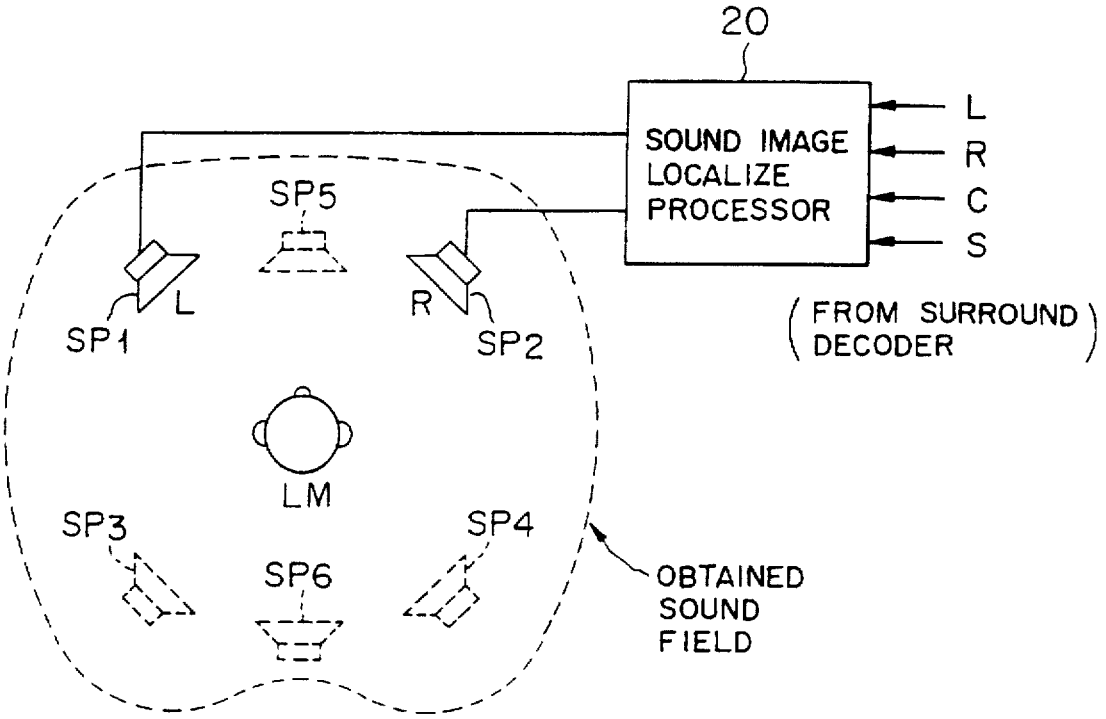
FIG. 2 is an illustration for assistance in explaining the prior art sound image localization processing.
Figure 3:
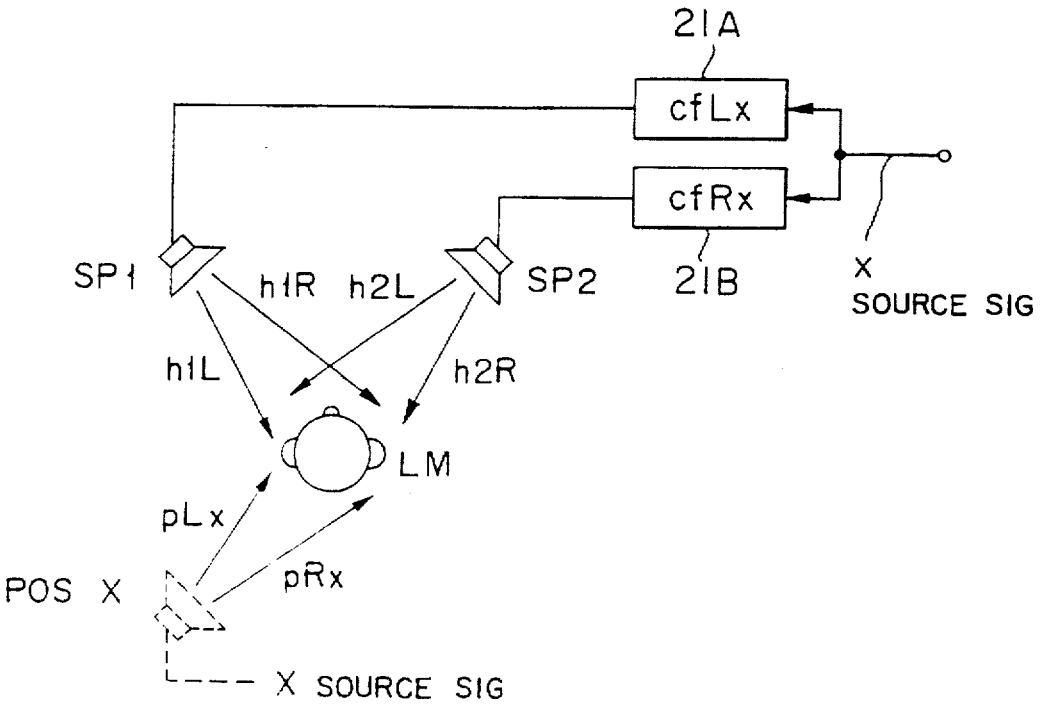
FIG. 3 is an illustration for assistance in explaining the principle of the sound image localization processing.

In this case, two preconditions are: (1) two front reproducing speakers SP1 and SP2 are arranged at two roughly symmetrical positions with respect to and in front of a listener LM; and (2) two sound images of two different surround signals are localized at two rear positions (two virtual speaker reproduction positions SP3 and SP4) arranged also at two roughly symmetrical positions with respect to and behind the listener LM. Under consideration of these preconditions, the principle illustration as shown in FIG. 3 can be simplified as shown in FIG. 7. In FIG. 7, the reference numeral 1 denotes a sound image localization processing circuit shown in FIG. 6 for localizing two different sound images at two symmetrical positions with respect to the listener LM, which is the essential portion of the present invention.

As shown in FIG. 7, the listener LM is positioned at a middle position between the two front speakers SP1 and SP2, so that the transfer functions between the two speakers and the listener's head are symmetrical with respect to the listener LM. That is, since the transfer functions h1L and h2R from the speakers SP1 and SP2 to the same side ears are equal to each other and further the transfer functions h1R and h2L from the speakers SP1 and SP2 to the opposite side ears (crosstalk components) are equal to each other, these transfer functions S and A can be expressed as (see FIGS. 3 and 7):

$$h1L=h2R=S$$

$$h1R=h2L=A$$

Further, for sound image localization, the transfer functions F and K can be expressed as (see FIGS. 3 and 7):

$$pLx=F$$

$$pRx=K$$

Therefore, the sound images can be localized by substituting the above four expressions into the formulae (14a) to (14c). In other words, if the input signals to the processing circuit 1 are denoted as X and Y, the output X' and Y' of the front speakers (SP1 and SP2) can be expressed as:

$$X'=(SF-AK)*X/(S^2-A^2) \quad (1)$$

$$Y'=(SF-AK)*X/(S^2-A^2) \quad (1b)$$

Therefore, it is possible to localize the sound images on the basis of the signal processing in accordance with the formulae (1a) and (1b) above.

On the other hand, in the sound image localization processing circuit 1 shown in FIG. 6, the transfer characteristics P and N of the first and second filters 4 and 5 are as afore-mentioned:

$$P=(F+K)/(S+A)$$

$$N=(F-K)/(S-A)$$

Accordingly, the outputs X' and Y' of the pair of speakers SP1 and SP2 (the outputs of the sound image localization processing circuit 1) can be calculated hereinbelow. That is, since an addition of and a subtraction between the two inputs X and Y applied to the sound image localization processing circuit 1 are processed through the first and second filters 4 and 5, and further since an addition of and a subtraction between these processed outputs are outputted from the sound image localization processing circuit 1 as the two output signals X' and Y', the following formula can be obtained:

$$\begin{aligned} X' &= (F+K)*(X+Y)/(S+A) - \\ &\quad (F-K)*(Y-X)/(S-A) \\ &= \text{NUMERATOR}/(S^2-A^2) \end{aligned}$$

Here, the numerator can be calculated as:

$$\text{NUMERATOR}=2(SFX+SKY-AFY-AKX)$$

Therefore, X' can be obtained as:

$$X'=2(SFX+SKY-AFY-AKX)/(S^2-A^2)$$

In the same way, Y' can be obtained as:

$$Y'=2(SFX+SKY-AFY-AKX)/(S^2-A^2)$$

Accordingly, when an input of Y=0(X=SL) is added, the following formulae can be obtained as:

$$\begin{aligned} X' &= 2(SFX-AKX)/(S^2-A^2) \quad (2a) \\ &= 2(SF-AK)*X/(S^2-A^2) \\ Y' &= 2(SKX-AFX)/(S^2-A^2) \quad (2b) \\ &= 2(SK-AF)*X/(S^2-A^2) \end{aligned}$$

As a result, it is possible to obtain the results equivalent to the afore-mentioned formulae (1a) and (1b). In other words, when only X is applied to the X side input of the sound image localization processing circuit 1 shown in FIG. 7, as clearly understood by the formulae (2a) and (2b), it is possible to localize the sound image of the rear surround signal SL at the localization position SP3 shown in FIG. 7, on the basis of the convolution processing.

Further, when an input of X=0(Y=SR) is applied to the sound image localization processing circuit 1, the following formulae can be obtained:

$$\begin{aligned} X' &= 2(SKY-AFY) \quad (3a) \\ &= 2(SF-AF)*Y/(S^2-A^2) \\ Y' &= 2(SFY-AKY) \quad (3b) \\ &= 2(SF-AK)*Y/(S^2-A^2) \end{aligned}$$

Here, in comparison of the formulae (3a) and (3b) with those (2a) and (2b), it is understood that two left and right opposite coefficients (transfer characteristics) are convolved to the input Y of the sound image localization processing circuit 1 shown in FIG. 7. In other words, the sound image of the signal inputted to the Y side of the sound image localization processing circuit 1 can be localized at the left and right symmetrical positions, in relation to the signal inputted to the X side thereof. Namely, in accordance with the convolution processing, it is possible to localize the sound image of the rear surround signal SR at the localization position (the speaker SP4) as shown in FIG. 7.

Accordingly, if the rear surround signals SL and SR are given as the input signals X=SL and Y=SR, since the principle of superposition can be established, it is possible to localize the sound image of the rear stereophonic signal (the surround signal) SL at the left side SP3 and the sound image of the rear stereophonic signal (the surround signal) SR at the right side SP4 both as shown in FIG. 7.

Figure 10A:
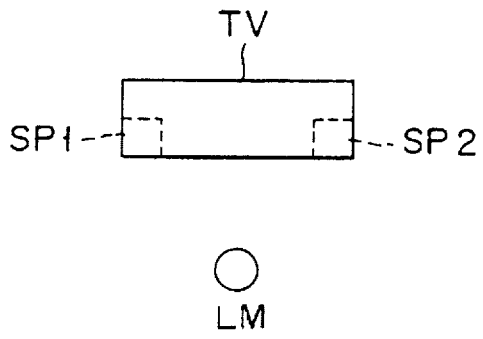
FIGS. 10A, 10B and 10C are illustrations for assistance in explaining the effect of the surround signal processing apparatus (as an audio video reproducing apparatus)
Figure 10B:
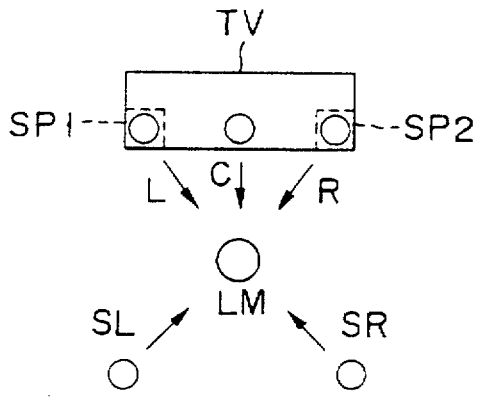

That is, as shown in FIG. 10A, when only a pair of speakers SP1 and SP2 are arranged on both sides of a television set TV, the same sound effect as with the case where four speakers are arranged as shown in FIG. 10B can be obtained. In other words, without arranging any rear speakers, it is possible to reproduce the stereophonic surround sound on the basis of the front stereophonic signals and the rear stereophonic signals (surround signals) localized backward from a listener.

Figure 4:
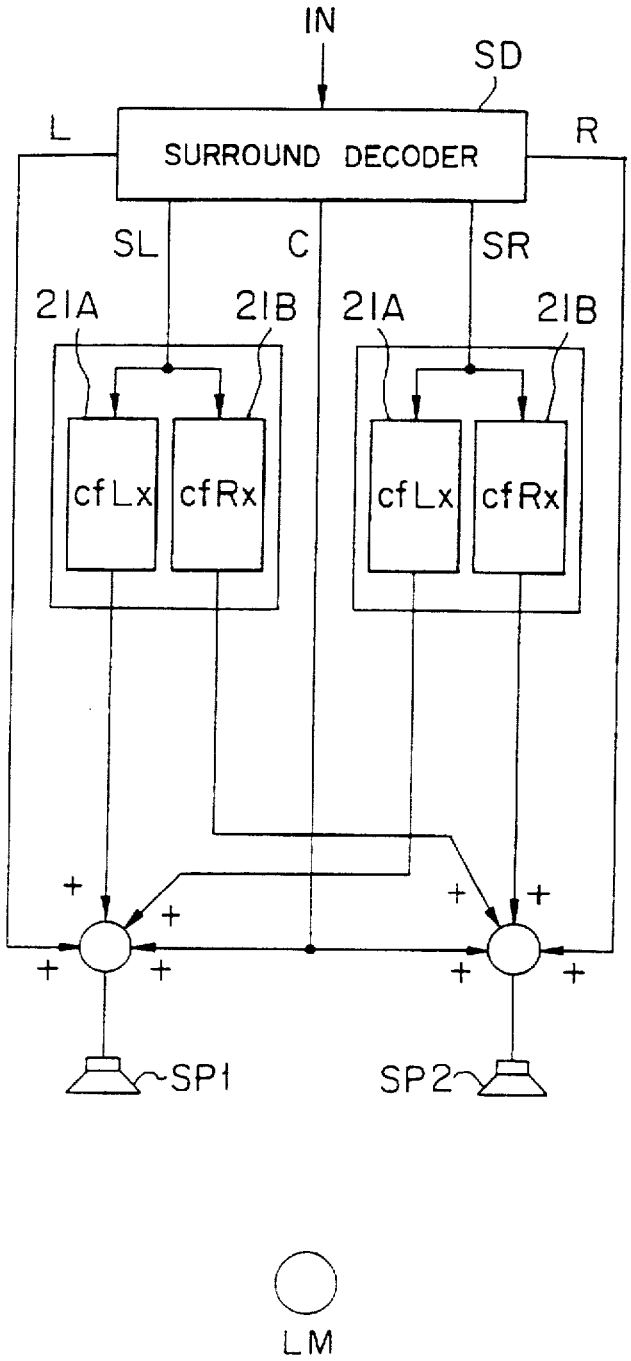
FIG. 4 PRIOR ART
FIG. 4 is a block diagram showing a prior art surround signal processing apparatus.

In the case of the prior art surround signal processing apparatus shown in FIG. 4, the four filters are required to localize the sound images of the rear stereophonic (surround) signals at two different positions. In the case of the above-mentioned embodiment shown in FIG. 6, however, it is possible to construct the surround signal processing apparatus by use of only two (first and second) filters 4 and 5, so that the hardware scale can be reduced by half.

Figure 10C:
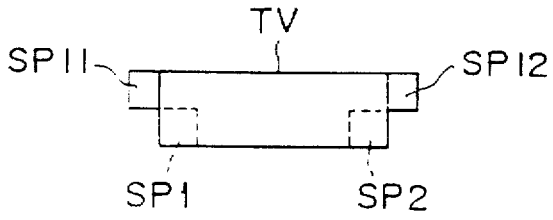

Further, it is also possible to reproduce the addition signals of the front stereophonic signals L and R, the center signal C and further the rear stereophonic (surround) signals through two different pairs of speakers. In this case, as shown in FIG. 10C, the additional front speakers SP11 and SP12 are arranged on the front side (e.g., on both outer sides) of the television set TV.

In this arrangement, the addition signals of the front stereophonic signals L and R and the center signal C are reproduced through the front speakers SP1 and SP2; and the rear stereophonic (surround) signals (whose sound images are localized) are reproduced through the additional front speakers SP11 and SP12, respectively. In this case, it is unnecessary to add the front stereophonic signal L or R, the center signal C, and the rear stereophonic (surround) signals X' or Y' (whose sound images are localized) by use of the third and fourth adders 8 and 9 shown in FIG. 6.

In the construction as described above, since the characteristics and the arrangement directions of the front speakers SP1 and SP2 and the additional speakers SP11 and SP12 can be determined separately, it is possible to obtain a higher surround effect.

Figure 11:
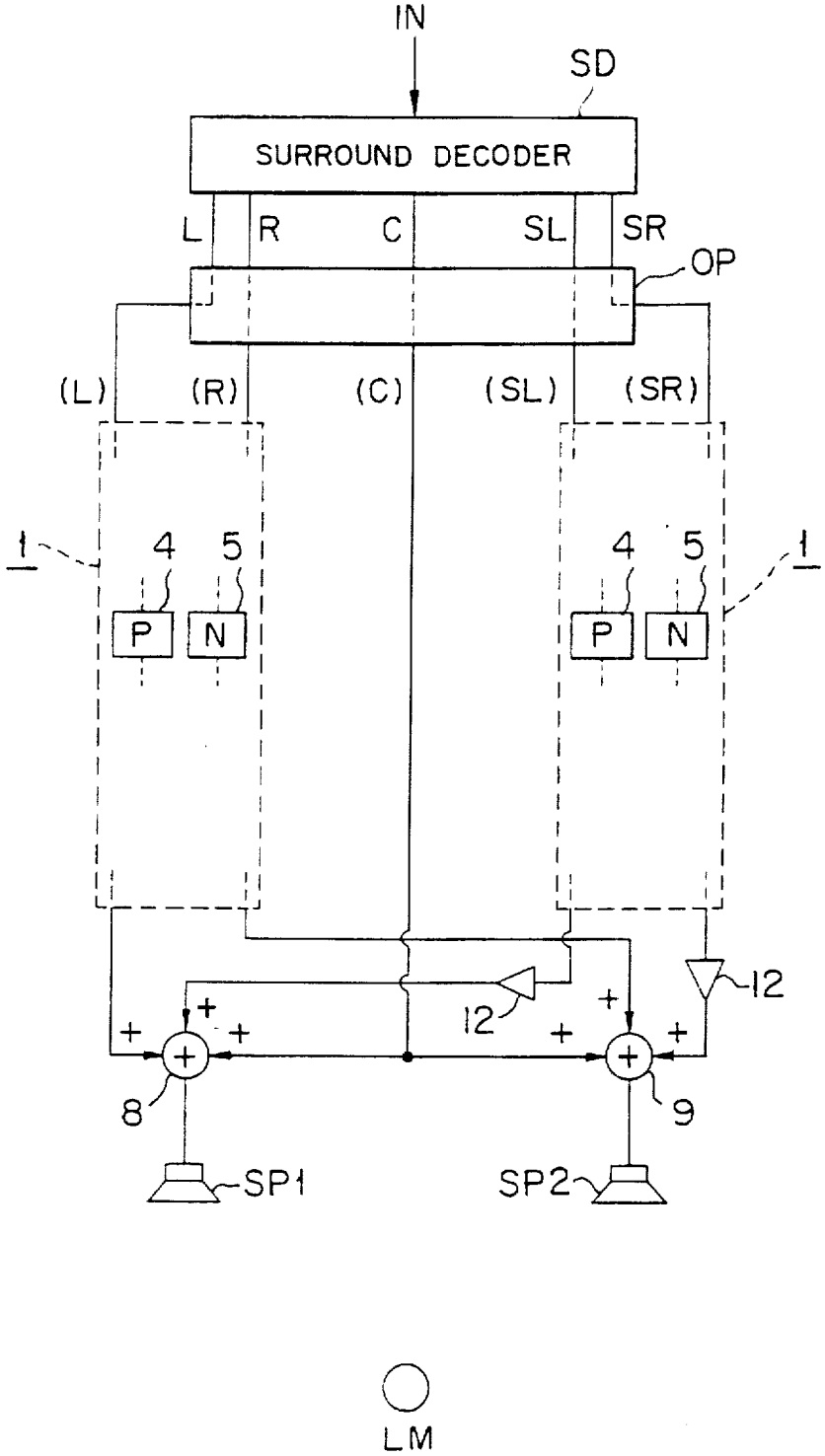
FIG. 11 is a block diagram showing a modification of the first embodiment of the surround signal processing apparatus according to the present invention.

FIG. 11 shows a modification of the first embodiment of the processing apparatus shown in FIG. 6, in which not only the rear stereophonic signals SL and SR but also the front stereophonic signals L and R are processed for sound image localization.

In the same way as with the case of the sound image localization processing for the rear stereophonic signals SL and SR, the sound images of the front stereophonic signals L and R are localized at two symmetrical left and right positions (a pair of virtual front speaker arrangement positions) with respect to a listener LM. In this case, when the filter coefficients are optimized as already explained, it is possible to execute the sound image localization processing by use of a sound image localization processing circuit including only two filters, adders and subtracters, respectively. Further, in the front and rear sound image localization processing circuit 1 (in which only the first and second filters 4 and 5 are shown) shown in FIG. 11, the filter coefficients are set to the filters so as to correspond to the sound image localization positions, respectively.

In the prior art processing apparatus, in order to localize the sound images of the front stereophonic signals and the rear stereophonic (surround) signals at different positions, 8 filters in total are necessary. In the above-mentioned modification, however, it is possible to construct the processing apparatus by using two first filters 4 and two second filters 5, that is, only 4 filters in total, so that the hardware scale can be reduced to that extent.

Figure 12A:
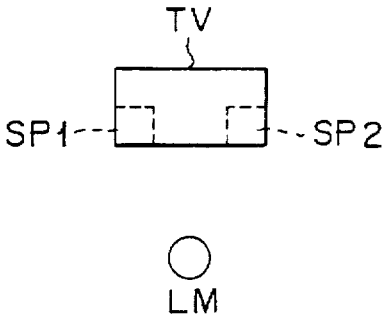
FIGS. 12A and 12B are illustrations for assistance in explaining the effect of the surround signal processing apparatus (as an audio video reproducing apparatus)
Figure 12B:
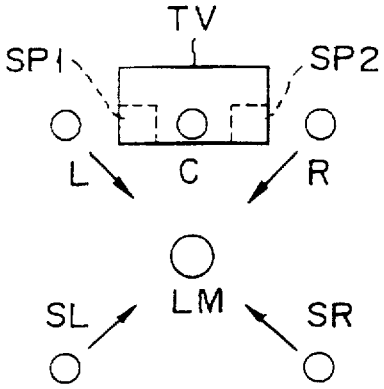

Accordingly, as shown in FIG. 12A, when only a pair of the speakers SP1 and SP2 are arranged on both sides of a television set TV, it is possible to localize the sound images of the front stereophonic signals at positions apart from both sides of the television set (displaying means), as shown in FIG. 12B. In the case of a narrow television set, the interval at which the two speakers are arranged is restricted. In this modification, however, it is possible for a listener to enjoy the surround sound without deteriorating the front stereophonic sound feeling. In addition, in the construction of this modification, a surround sound of sufficient stereophonic feeling can be reproduced on the basis of the front stereophonic signals and the rear stereophonic (surround) signals (whose sound images are localized backward from a listener) in combination. In this modification, in particular since the number of the filters can be reduced as compared with that of the conventional processing apparatus, the apparatus cost can be reduced and thereby it is possible to incorporate the processing apparatus in low-priced television sets used as home appliances.

Figure 13:
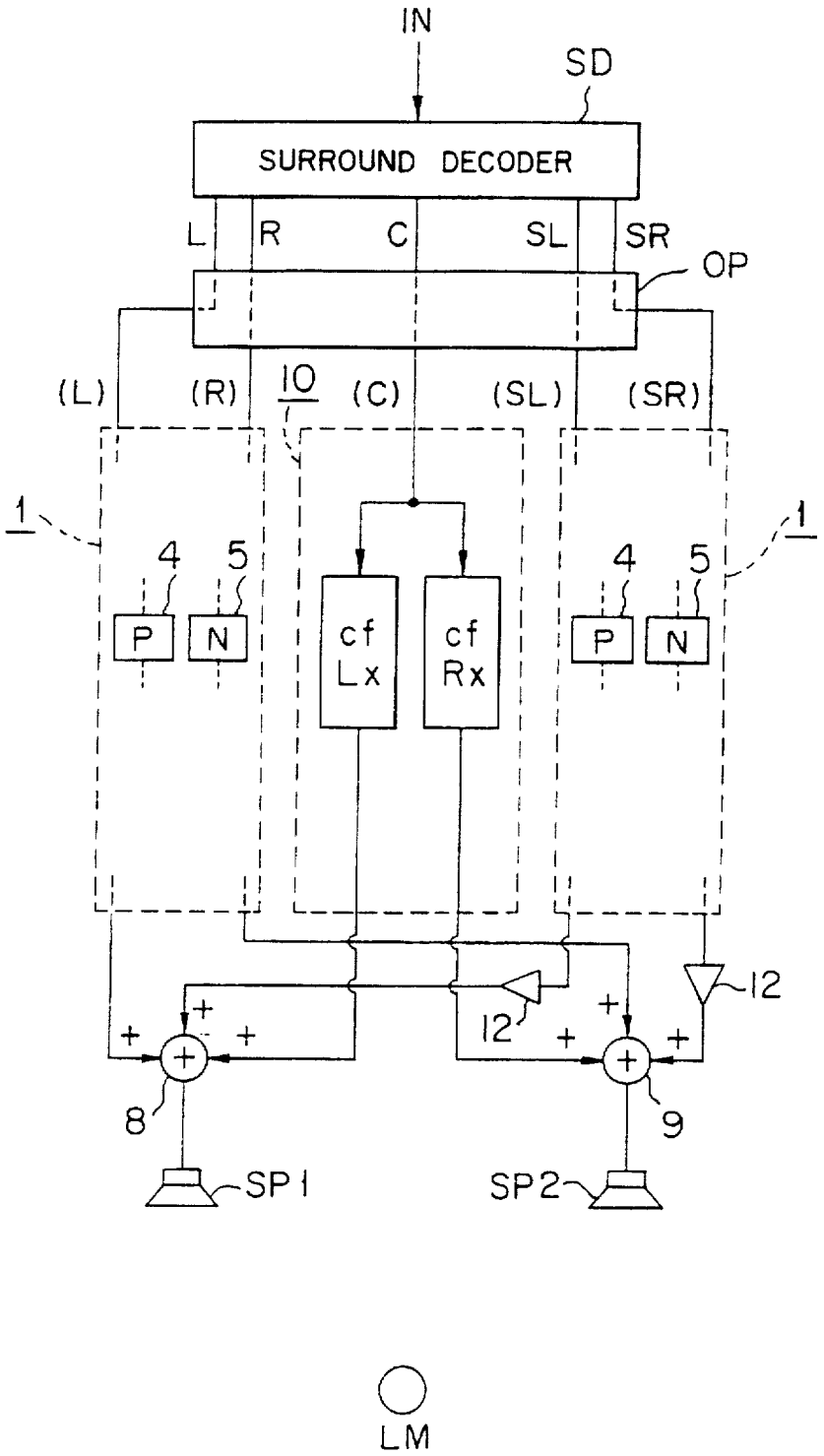
FIG. 13 is a block diagram showing another modification of the first embodiment of the surround signal processing apparatus according to the present invention.

FIG. 13 shows another modification of the first embodiment of the processing apparatus, in which the sound image of the center signal C is localized in addition to the rear stereophonic signals SL and SR and the front stereophonic signals L and R.

In the case of a television set having a wide picture, a large-sized projector or a screen of a cinema theater, it is impossible to place a speaker for the center signal at the front middle of the picture (displaying means).

However, it is possible to execute the sound image localization processing for the center signal C so that the sound image of the center signal C can be localized at the front middle position of the picture by using an additional sound image localization processing circuit 10 (in which the number of the filters is reduced), as shown in FIG. 13.

In more detail, in the conventional way, when the center signal C is reproduced, since the display unit is disposed at the middle position thereof (at which the center speaker is to be arranged), the center speakers must be disposed on both or either of left and right sides or upper and lower sides of the display unit.

When two speakers are arranged on both sides of the display unit, the sound images of the center signal C are the same as with the case of the front stereophonic reproduction, so that the articulation rate of the sound image is degraded, as compared with when the speaker is arranged at an originally required sound image position (a central position).

Figure 14A:
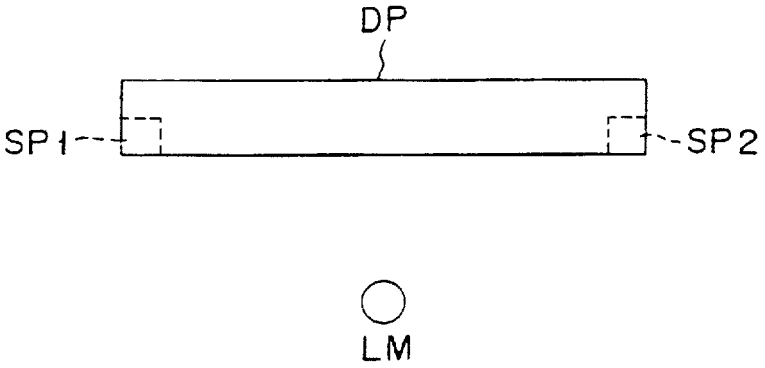
FIGS. 14A and 14B are illustrations for assistance in explaining the effect of the surround signal processing apparatus (as an audio video reproducing apparatus)
Figure 14B:
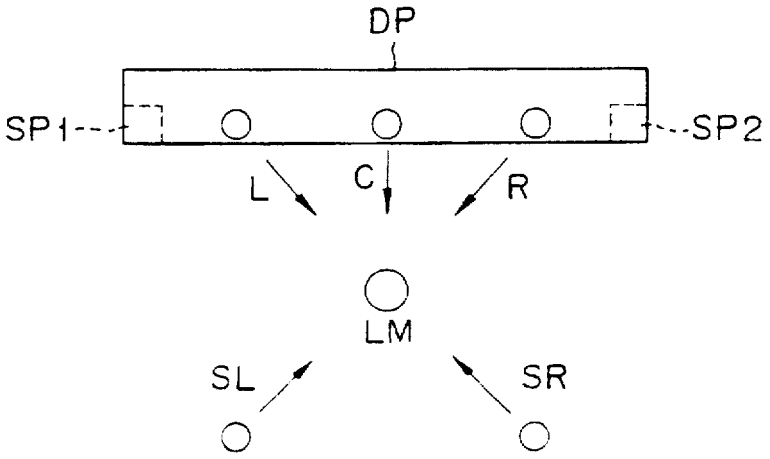

On the other hand, when the speaker is disposed on the upper or lower side of the display unit, a sound mismatching occurs inevitably between the required sound image localization position and the speaker position. Therefore, in this modification, the sound image localization of the center signal C is processed so as to be localized at the front middle position of the display unit. Further, as shown in FIG. 14A, a pair of speakers SP1 and SP2 are arranged on both sides of a television set in contact with both side surfaces of the display unit DP. In the construction as described above, the surround effect as shown in FIG. 14B can be obtained, which is roughly the same as when the center signal C would be reproduced from a front speaker disposed at the middle position of the display unit DP.

Therefore, since the obtained sound image is localized within the picture, the quality of the sound image is further articulated. In particular, in comparison with when the center signal C is reproduced through two left and right speakers SP1 and SP2 as a monophonic signal, it is possible to allow the viewer to recognize the center position of the picture more accurately, without producing any mismatching (between the actual picture center and the sound image center) in the vertical direction of the picture.

Further, in the case of the audio video reproducing apparatus provided with a wide display unit such as a television set having a wide picture, a large-sized projector or a screen of a cinema theater, it is preferable to localize the sound images of the front stereophonic signals L and R on the upper side of the display unit.

[Embodiment 2]

Figure 15:
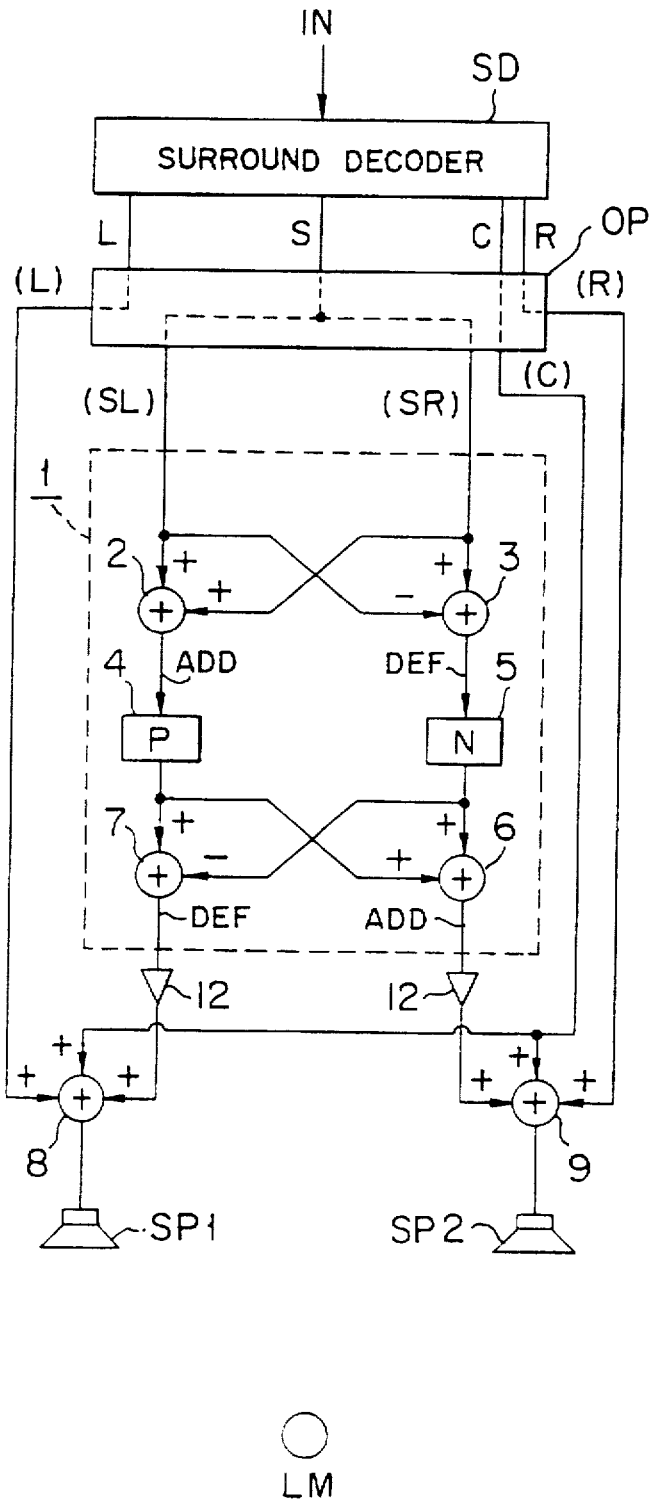
FIG. 15 is a block diagram showing a second embodiment of the surround signal processing apparatus according to the present invention.

FIG. 15 shows a second embodiment of the surround signal processing apparatus, by which the surround sound can be reproduced on the basis of a single-system monophonic rear surround signal. That is, the rear signal S is a single-system monophonic surround signal. The rear signal S demodulated by the surround processing circuit (surround decoder) SD is processed by the additional signal processing circuit OP for amplitude adjustment, reverberation processing, and reflected sound addition, and then is further divided into twice signals. These two-divided two signals are further processed by the sound image localization processing circuit 1 so as to be localized at two rear positions, respectively.

In the above-mentioned processing, it is preferable to localize the two sound images of the two different and independent left and right rear signals SL and SR (not related to each other) at two different rear positions, after these twice-divided rear signals SL and SR have been processed as to the different amplitude adjustment, reverberation processing and reflected sound addition, by the additional signal processing circuit OP. This is because when the sound image of the monophonic rear signal S is localized at two left and right positions as it is, the sound images cannot be localized or localized within the head of a listener.

Figure 5:
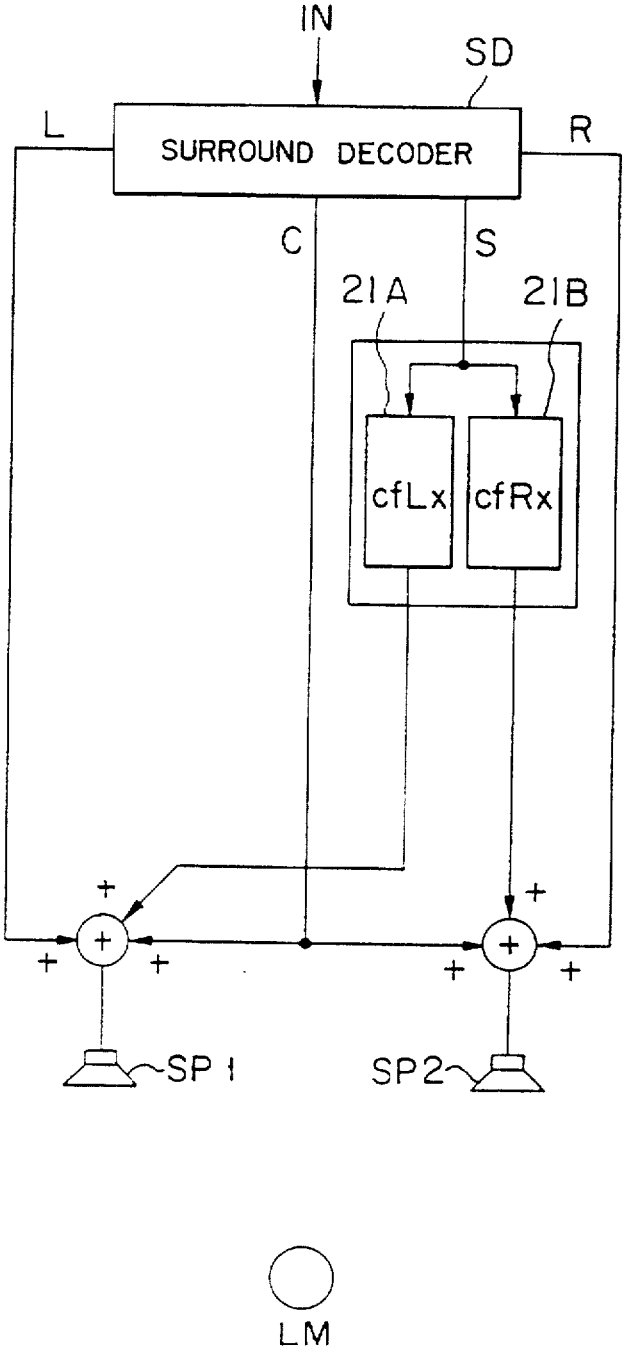
FIG. 5 PRIOR ART
FIG. 5 is a block diagram showing another prior art surround signal processing apparatus.
Figure 16A:
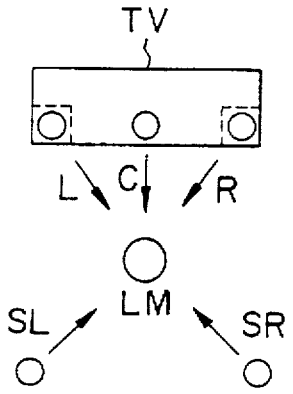
FIGS. 16A and 16B are illustrations for assistance in explaining the effect of the surround signal processing apparatus (as an audio video reproducing apparatus) shown in FIG. 15.

As described above, when the sound image localization of the single-system monophonic surround signal is processed, and further reproduced through two speakers arranged at two rear left and right positions as two different rear signals SL and SR, as shown in FIG. 16A, it is possible to manifest the rear sound field and to shift the sound images more articulately than the in case of the prior art apparatus, as shown in FIG. 5, by which the sound image can be localized at only one rear position of a listener, with the result that a sufficient surround effect can be obtained. In this embodiment, only two filters are necessary, so that the apparatus can be realized by a simple configuration.

[Embodiment 3]

Figure 17:
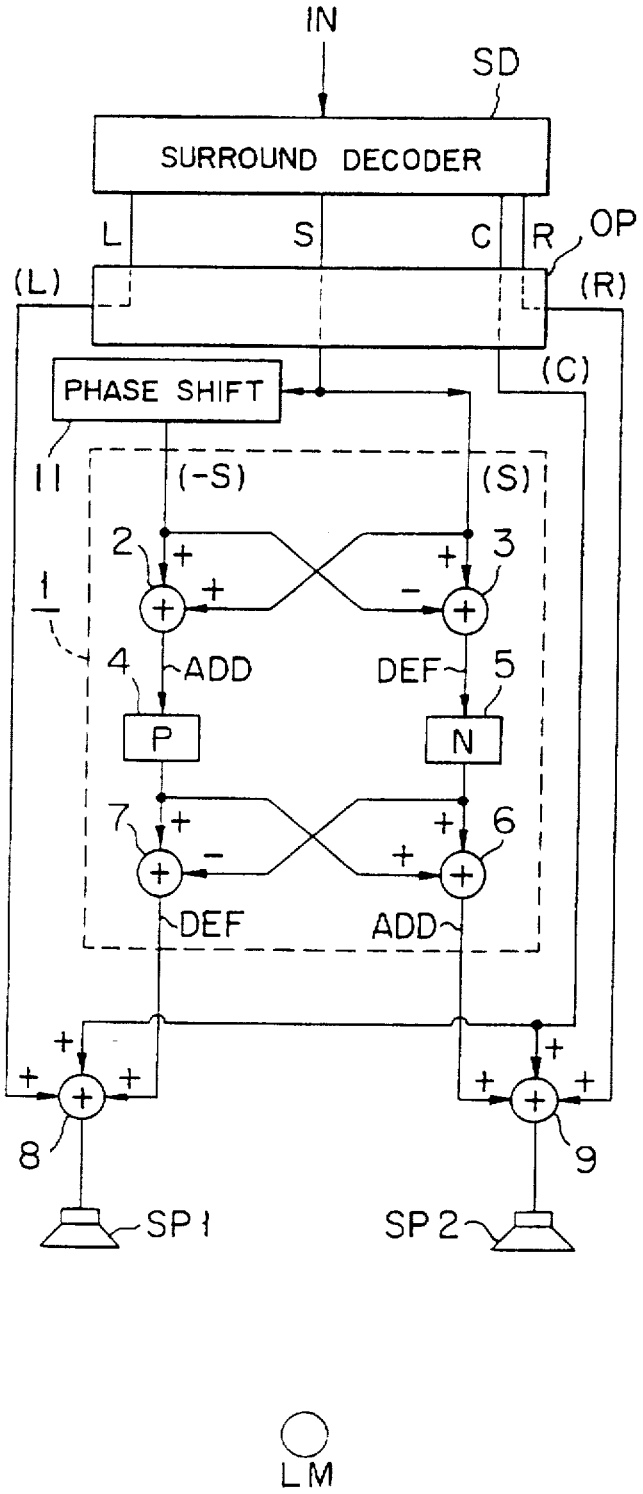
FIG. 17 is a block diagram for assistance in explaining how to simplify the second embodiment of the surround signal processing apparatus.
Figure 18:
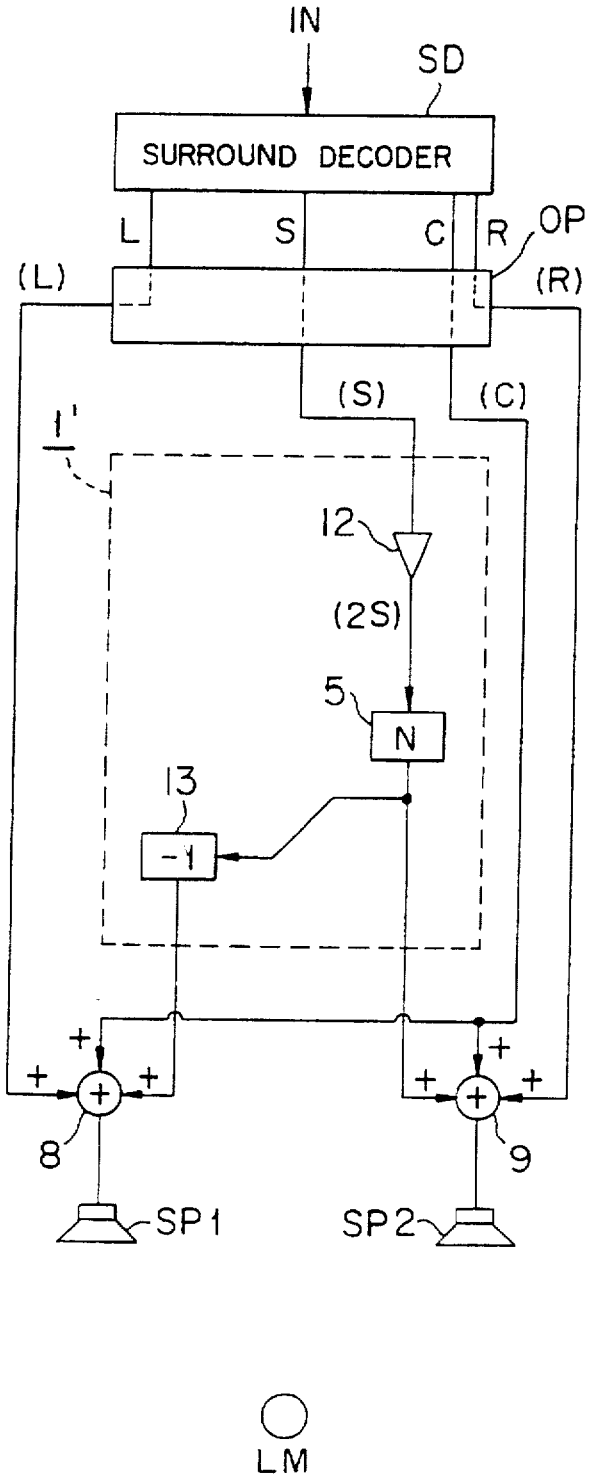
FIG. 18 is a block diagram showing a third embodiment of the surround signal processing apparatus according to the present invention.

FIG. 17 is a block diagram for assistance in explaining how to simplify the second embodiment shown in FIG. 15, and FIG. 18 shows a third embodiment of the surround signal processing apparatus according to the present invention. In the second embodiment shown in FIG. 15, two independent rear left and right signals SL and SR not related to each other are used. In the third embodiment, however, two rear left and right rear signals S and −S whose phases are opposite to each other are used. That is, a phase shift circuit 11 is additionally provided in the apparatus shown in FIG. 17, as compared with that shown in FIG. 15. That is, the rear signal S demodulated by the surround processing circuit SD is shifted in phase by the phase shift circuit 11, so that two left and right rear signals S and −S opposite in phase to each other can be obtained.

In the apparatus shown in FIG. 17, since two left and right rear signals S and −S are used as the rear stereophonic signals, the signal applied to the filter 4 is 0, so that it is unnecessary to process the input and output of the signal of this system. That is, in an adder 2 shown in FIG. 17, the addition result is:

$$S+(-S)=0$$

and in a subtracter 3 shown in FIG. 17, the subtraction result is:

$$S-(-S)=2S$$

Accordingly, the rear surround signal S can be doubled and then applied to the filter 5. Further, since the amplitude thereof can be adjusted by the additional signal processing circuit OP, it is not always necessary to double the rear surround signal S inputted to the filter 5; that is, the surround signal S can be used as it is.

Further, when the rear surround signal S is doubled, since the signal applied to the filter 4 is 0 and further the input and output processing of the signal for this system can be omitted, an adder 2, a subtracter 3, a first filter 4, another adder 6, another subtracter 7 and a phase shift circuit 7 can be all omitted. In other words, the sound image localization processing circuit 1 shown in FIG. 17 can be further simplified as shown in FIG. 18, in which only a filter 5, an amplitude adjuster 12, an inverter 13 are provided. In this apparatus configuration, since the number of filters is one, it is possible to further reduce the scale of the hardware.

Figure 16B:
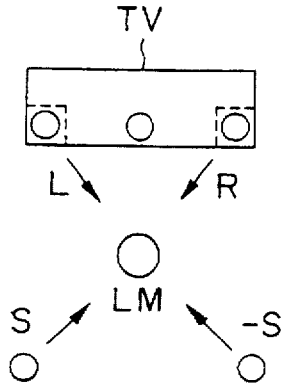

As a result, when a pair of the speakers SP1 and SP2 are arranged on both sides of the television set TV as shown in FIG. 16B, it is possible to easily reproduce the surround sound by use of only two speakers. In addition, as already explained, since the configuration of the surround signal processing apparatus is extremely simple as shown in FIG. 18, the apparatus of this embodiment can be applied to low-priced television sets as the ordinary home appliances.

As described above, when the single-system monophonic surround signal is reproduced on the basis of the two left and right opposite-phase rear signals, after the sound images thereof have been localized at two rear left and right positions respectively, it is possible to manifest the rear sound field and to shift the sound images more articulately than the case of the prior art apparatus by which the sound image can be localized at only one rear position of a listener, with the result that a sufficient surround effect can be obtained. In this embodiment, since only one filter is used, the configuration of the apparatus can be extremely simplified.

Further, in the afore-mentioned embodiments, it is possible to localize the sound images at any desired positions by modifying the transfer characteristics F and K between the positions at which the sound images are required to be localized and the listener's ears; that is, by modifying the transfer characteristics P and N of the first and second filters 4 and 5, respectively.

In practice, the transfer characteristics P and N (the filter coefficients) according to a plurality of the sound image localization positions are stored in the memory 14 such as RAM or ROM as shown in FIG. 6; the transfer characteristics according to the desired sound image localization positions are read from the memory 14 by the CPU 15; and the read transfer characteristics are set to the first and second filters 4 and 5, respectively.

In the construction as described above, since the left and right sound images can be adjustably rotated around the listener LM, it is possible to reproduce the surround sound under the optimum conditions for the listener LM.

Further, in the afore-mentioned embodiments, although a pair of speakers SP1 and SP2 are used as the pair of transducers, the speakers can be also replaced with two head-less type speakers or a headphone. In this case, since the transfer characteristics related to the crosstalk A are canceled with each other and therefore not present basically, the transfer characteristics A between a pair of the speakers LF and RF and the opposite sides of ears of the listener LM can be considered to be roughly zero in the afore-mentioned embodiments, and thereby can be omitted. In contrast with this, when the frequency characteristics of the headphone are taken into account and added to the transfer characteristics A, it is possible to realize a more actual sound field.

Further, in any of the afore-mentioned embodiments, when the present invention is applied to the audio video reproducing apparatus such as a television set, a pair of (stereophonic) speakers (SP1 and SP2) are usually disposed on both sides of the display unit for reproducing picture. Further, the viewer (listener LM) hears the sound directly in front of the display unit. Therefore, the pair of speakers (SP1 and SP2) are usually arranged roughly symmetrically with respect to the listener (LM). On the other hand, two sound images of two different surround signals are localized at two different rear positions also roughly symmetrically with respect to the listener (LM). In this case, however, no problems may arise. Rather, this is desirable from the standpoint of surround effect.

Accordingly, it is extremely effective to combine the sound image localization processing apparatus (which is the essential portion of the present invention) with the audio video reproducing apparatus such as the television set, in order to provide an additional surround function to the television set, because the sound image localization processing apparatus according to the present invention can localize two sound images of the surround signals at roughly two rear symmetrical positions with respect to the listener, with the use of only a pair of speakers arranged at roughly two front symmetrical positions with respect to the same listener.

[Embodiment 4]

Figure 19:
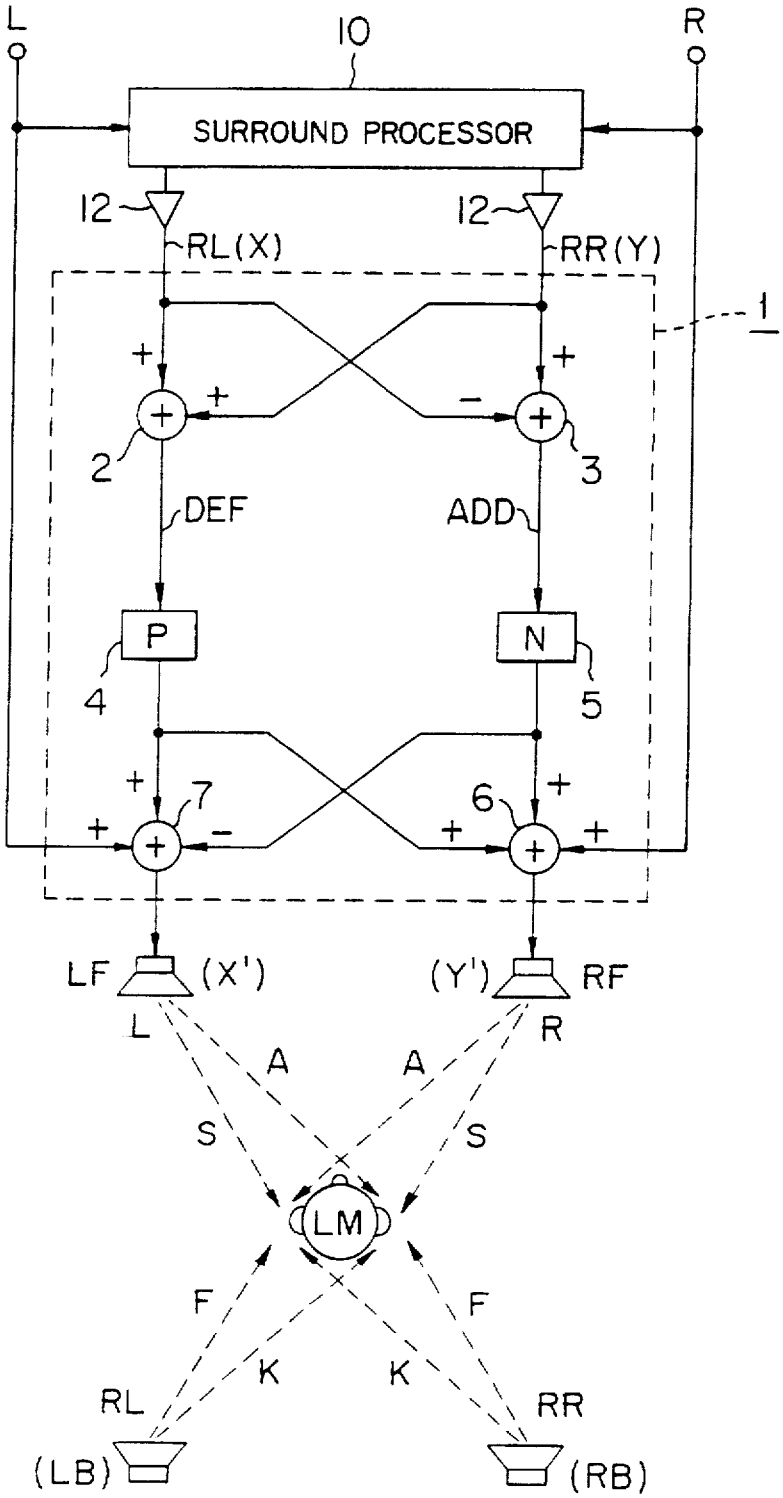
FIG. 19 is a block diagram showing a fourth embodiment of the surround signal processing apparatus according to the present invention.

FIG. 19 shows a fourth embodiment of the surround signal processing apparatus according to the present invention. As shown, the processing apparatus is composed of a surround processor 10, two amplitude adjusters 12 and a sound image localization processor 1 including a first adder 2, a first subtracter 3, a first filter 4, a second filter 5, a second adder 6 and a second subtracter 7. The surround processor 10 is means for forming rear stereophonic (surround) signals RL and RR on the basis of inputted front stereophonic signals L and R, respectively. The surround processor 10 is composed of an amplitude adjusting circuit, a reverberation adding circuit, a reflected sound adding circuit, etc. which are all well known. Further, the first filter 4 and the second filter 5 are both convolution calculating means such as convolvers provided with transfer characteristics P and N both described in detail in association with the first embodiment, respectively.

The rear stereophonic signals RL and RR applied by the surround processor 10 are inputted to the amplitude adjusters 12 and 12, respectively, in which amplitudes of the rear stereophonic signals RL and RR are adjusted with respect to the front stereophonic signals L and R and then inputted to the sound image localization processor 1. Here, an addition signal (RL+RR) of both and a subtraction signal (RL−RR) between both are generated by the first adder 2 and the first subtracter 3, respectively. The generated first addition signal is processed by the first filter 4, and the generated first subtraction signal is processed by the second filter 5. Further, the two signals processed by the first and second filters 4 and 5 are applied to the second adder 6 and the second subtracter 7, respectively.

Further, the second adder 6 adds the processed output signals of the two filters 4 and 5 and the front stereophonic signal R. On the other hand, a second subtracter 7 subtracts the processed output signal of the filter 5 from the addition of the output signal of the filter 4 and the front stereophonic signal L. The pair of stereophonic signals X' and Y' obtained as described above are reproduced through a pair of transducers (a pair of speakers LF and RF, in this embodiment) respectively, so that a listener LM can hear the reproduced sound. Here, the two speakers LF and RF are arranged in front of the listener LM in symmetrical positional relationship with respect to the listener LM.

In the surround signal processing apparatus constructed as described above, when the rear stereophonic signals RL and RR (surround signals) applied by the surround processor 10 are processed and then reproduced through a pair of the speakers LF and RF, in the same way as with the case of the afore-mentioned embodiments, the rear stereophonic signal transmitted from the left speaker LF to the right ear of the listener LM are canceled by that from the right speaker RF to the left ear of the same listener LM; that is, the crosstalk can be canceled with each other. Therefore, the listener LM can hear only the sound reproduced by the left speaker LF by only his left ear and the sound reproduced by the right speaker RF by only his right ear. Further, the sound image localization processing is executed according to the transfer characteristics F and K in the same way as with the case of the first embodiment, so that it is possible to localize the sound images at the two required sound image localization positions (at LB and RB), respectively.

[Embodiment 5]

Figure 20:
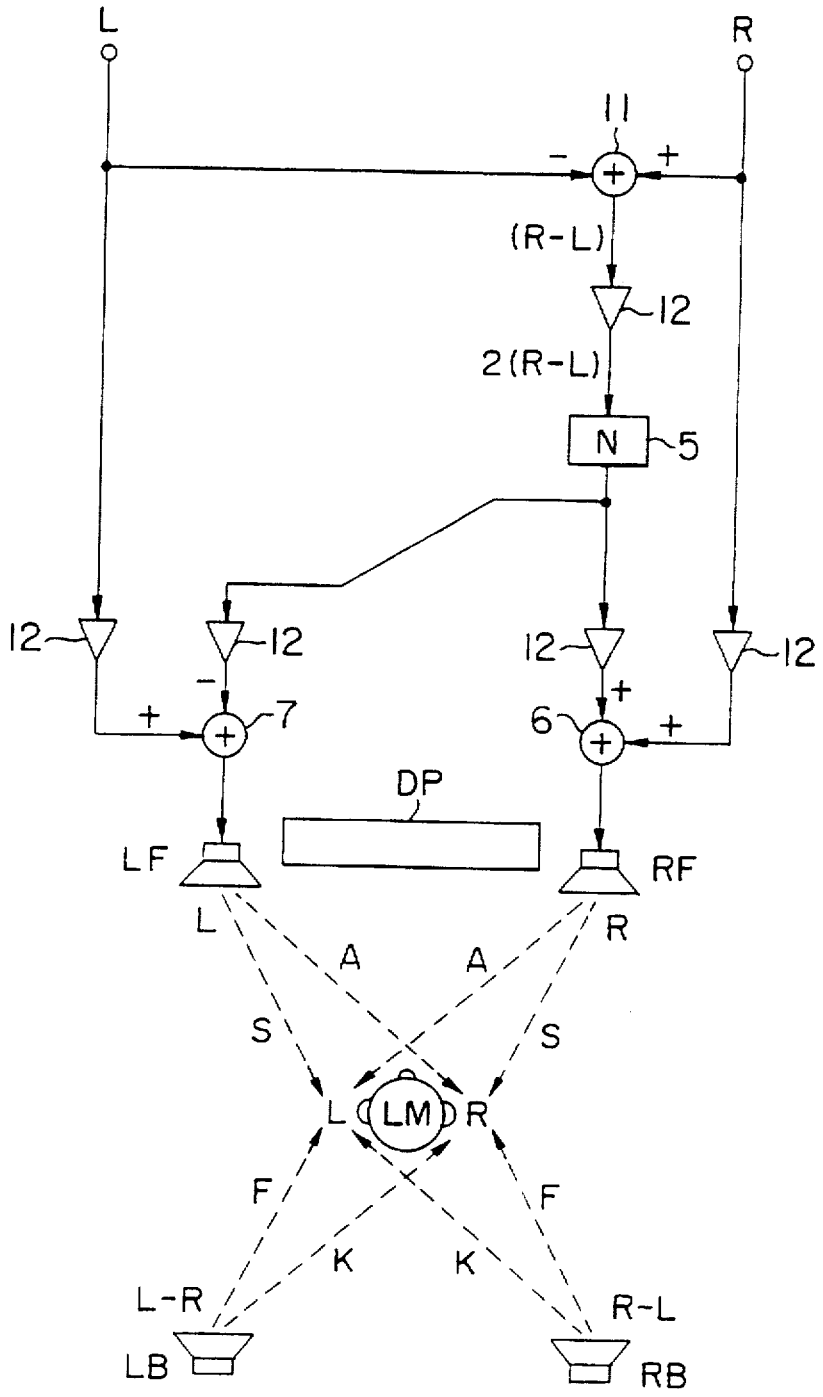
FIG. 20 is a block diagram showing a fifth embodiment of the surround signal processing apparatus according to the present invention.

FIG. 20 shows a fifth embodiment of the surround signal processing circuit according to the present invention. In this embodiment, the front stereophonic signals (Lch- and Rch-stereophonic signals) are processed through a subtraction matrix to form an (L−R) signal and an (R−L) signal, respectively for surround processing. The formed signals are reproduced as the rear stereophonic (surround) signals, so that it is possible to further simplify the apparatus configuration.

In this embodiment, since the (L−R) signal and (R−L) signal are used as the rear stereophonic signals, the signal applied to the first filter 4 is 0, so that it is unnecessary to process the signal of this system. That is, the first adder 2 shown in FIG. 19 obtains the following expression:

$$RL+RR=(L-R)+(R-L)=0$$

The subtracter 3 shown in FIG. 19 obtains the following expression:

$$RR-RL=(R-L)-(L-R)=2(R-L)$$

Therefore, the amplitude of the subtraction matrix signal (R−L) is doubled by the amplitude adjuster 12, and then applied to the second filter 5. Further, since the amplitude adjusting circuit is provided in the surround processor 10 shown in FIG. 19, it is not always necessary to double the subtraction matrix signal; that is, the signal (R−L) can be applied as it is.

Therefore, as shown in FIG. 20, the apparatus can be composed of only a filter 5, an adder 6, two subtracters 7 and 11, and an amplitude adjuster 12, so that it is possible to further reduce the hardware scale.

Accordingly, when the television set is constructed by arranging a pair of speakers LF and RF on both sides of a display unit DP, it is possible to reproduce 4-channel surround sound easily through the two speakers. In addition, as already explained, since the surround signal processing apparatus can be constructed simply, as shown in FIG. 20, the apparatus can be used with low-priced television sets as ordinary home appliances.

Further, in the afore-mentioned embodiments 4 and 5, it is possible to localize the sound images at any desired positions, as explained with reference to FIG. 6, by modifying the transfer characteristics F and K between the positions at which the sound images are required to be localized and the listener; that is, by modifying the transfer characteristics P and N of the first and second filters 4 and 5, respectively. In practice, as explained with reference to FIG. 6, the transfer characteristics P and N (the filter coefficients) and the relative amplitude characteristics (gain coefficients of the amplitude adjusters 12) according to a plurality of the sound image localization positions are stored in the memory such as RAM or ROM shown; the transfer characteristics and the relative amplitude characteristics according to the desired sound image localization positions are read from the memory by the CPU; and the read transfer characteristics and the relative amplitude characteristics are set to the first and second filters 4 and 5 and the amplitude adjusters 12, respectively. In the construction as described above, since the left and right sound images can be adjustably rotated around the listener LM, it is possible to reproduce the surround sound or emphasize the surround effect under the optimum conditions for the listener LM.

Further, in the afore-mentioned embodiments, although a pair of speakers SP1 and SP2 are used as the pair of transducers, the speakers can be also replaced with two head-less type speakers or a headphone. In this case, since the transfer characteristics A as to crosstalk are not present basically, the transfer characteristics A between a pair of the speakers LF and RF and the opposite side of the ears of the listener LM are considered to be roughly zero in the afore-mentioned embodiments, and thereby can be omitted. In contrast with this, when the frequency characteristics of the headphone are taken into account and added to the transfer characteristics A, it is possible to realize a more actual sound field.

As described above, in the surround signal processing apparatus according to the present invention, in spite of the extremely simple signal processing apparatus, it is possible to localize the sound images of the surround signals at two different rear positions apart from the two front positions at which a pair of speakers are arranged, on the basis of the sound signals reproduced through the speakers. Therefore, it is possible to reproduce two pseudo surround signals from a pair of virtual rear speakers by use of a pair of actual front speakers; that is, to construct a 4-channel surround system by use of only two speakers. Further, since being small in hardware scale and thereby low in cost, the surround signal processing apparatus according to the present invention can be used with the low-priced home appliances such as television sets.

In particular, when the present invention is applied to the rear surround signal reproduction system of single-system monophonic type, it is possible to manifest the rear sound field and to shift the sound images more articulately, with the result that a sufficient surround effect can be obtained.

What is claimed is:

1. An audio video reproduction method comprising the steps of:

processing an inputted rear surround signal in accordance with predetermined transfer characteristics;

inverting polarity of the signal processed during said step of processing the inputted rear surround signal to obtain an inversion signal thereof; adding the signal processed during said step of processing and one of two-channel front stereophonic signals, to output a first addition signal;

adding the inversion signal inverted during said step of inverting and the other of the two-channel front stereophonic signals, to output a second addition signal;

reproducing, responsive to the first and second addition signals, the inputted rear surround signal, together with the two-channel front stereophonic signals by a pair of speakers to localize sound images of the reproduced rear surround signals at predetermined positions relative to a listener; and reproducing a picture relative to the reproduced signals by a display unit, the speakers being arranged on both sides of the display unit, wherein:

the transfer characteristics are set as follows:

$$(F-K)/(S-A)$$

where S denotes transfer characteristics between one of the speakers and one of the listener's ears positioned on the same side as the speaker, respectively; A denotes transfer characteristics between the other of the speakers and one of the listener's ears positioned on an opposite side to the speaker, respectively; F denotes transfer characteristics between one of the two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes a reverse convolution calculation.

2. The audio video reproduction method of claim 1, further comprising the steps of:

storing a plurality of transfer characteristics according to a plurality of sound image localization positions, respectively; and reading the transfer characteristics according to at least one desired sound image localization position from a plurality of stored transfer characteristics and setting the read transfer characteristics to said step of processing.

3. The audio video reproduction method of claim 1, further comprising the step of reproducing a center surround signal, in addition to the rear surround signals and the front stereophonic signals.

4. The audio video reproduction method of claim 3, further comprising the steps of:

storing a plurality of transfer characteristics according to a plurality of sound image localization positions, respectively; and reading the transfer characteristics according to at least one desired sound image localization position from a plurality of stored transfer characteristics and setting the read transfer characteristics to said step of processing.

5. An audio video reproducing method comprising the steps of:

forming first and second independent signals on the basis of an inputted rear surround signal;

forming a first addition signal and a first subtraction signal, respectively on the basis of the first and second independent signals;

processing the first addition signal in accordance with first transfer characteristics P;

processing the first subtraction signal in accordance with second transfer characteristics N;

forming a second addition signal and a second subtraction signal, respectively on the basis of signals processed during said steps of processing; adding the second addition signal and one of two-channel front stereophonic signals, to output a third addition signal;

adding the second subtraction signal and the other of the stereophonic signals, to output a fourth addition signal;

reproducing, responsive to the third and fourth addition signals, the inputted rear surround signal, together with the two-channel front stereophonic signals by a pair of speakers to localize sound images of the reproduced rear surround signals at predetermined positions relative to a listener; and reproducing a picture relative to the reproduced signals, by a display unit, the speakers being arranged on both sides of the display unit, wherein:

the transfer characteristics P and N of said processing steps are set, respectively as follows:

$$P=(F+K)/(S+A)$$

$$N=(F-K)/(S-A)$$

where S denotes transfer characteristics between one of the speakers and one of the listener's ears positioned on the same side as the speaker, respectively; A denotes transfer characteristics between the other of the speakers and one of the listener's ears positioned on an opposite side of the speaker, respectively; F denotes transfer characteristics between one of two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes a reverse convolution calculation.

6. The audio video reproducing method of claim 5, and further comprising the step of reproducing a center surround signal, in addition to the rear surround signals and the front stereophonic signals.

7. An audio video reproducing method comprising the steps of:

forming rear surround signals on the basis of inputted front stereophonic signals;

forming a first addition signal and a first subtraction signal on the basis of the rear surround signals, respectively;

processing the first addition signal in accordance with first transfer characteristics P;

processing the first subtraction signal in accordance with second transfer characteristics N; and forming a second addition signal and a second subtraction signal on the basis of the signals processed during said steps of processing, respectively and outputting the formed signals; reproducing, based on the formed signals, the front stereophonic and rear surround signals by a pair of speakers to localize sound images of the inputted front stereophonic signals at predetermined positions relative to a listener; and reproducing a picture relative to the reproduced signals by a display unit, the speakers being arranged on both sides of the display unit, wherein:

the transfer characteristics P and N of said steps of processing are set, respectively as follows:

$$P=(F+K)/(S+A)$$

$$N=(F-K)/(S-A)$$

wherein S denotes transfer characteristics between one of the speakers and one of the listener's ears positioned on the same side as the speaker, respectively; A denotes transfer characteristics between the other of the speakers and one of the listener's ears positioned on an opposite side to the speaker, respectively; F denotes transfer characteristics between one of two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes a reverse convolution calculation, and wherein:

sound images of the first stereophonic signals can be localized at positions remote from both sides of or on the picture.

8. The audio video reproducing method of claim 7, further comprising the step of localizing a sound image of a center surround signal on the picture.

9. A surround signal processing method comprising the steps of:

forming a substraction signal on the basis of inputted two-channel stereophonic signals;

processing the subtraction signal in accordance with predetermined transfer characteristics;

forming an inversion signal by inverting polarity of the signal processed during said step of processing;

adding the signal processed during said step of processing and one of the stereophonic signals and outputting a first added signal;

adding the inversion signal obtained during said step of forming an inversion signal and the other of the stereophonic signals and outputting a second added signal;

reproducing, based on the first and second added signals, surround signals by a pair of transducers to localize sound images of the subtraction signals at positions different from those at which the surround signals are reproduced; and reproducing a picture relative to the reproduced signals by a display unit, the transducers being arranged on both sides of the display unit, wherein the transfer characteristics are set as follows:

$$(F-K)/(S-A)$$

where S denotes transfer characteristics between one of the transducers and one of the listener's ears positioned on the same side as the transducer, respectively; A denotes transfer characteristics between the other of the transducers and one of the listener's ears positioned on an opposite side to the transducer, respectively; F denotes transfer characteristics between one of two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes a reverse convolution calculation.

10. The surround signal processing method of claim 9, further comprising the steps of:

storing a plurality of transfer characteristics according to a plurality of sound image localization positions, respectively; and reading the transfer characteristics according to at least one desired sound image localization position from a plurality of stored transfer characteristics and setting the read transfer characteristics to the step of processing.

11. An audio video reproducing method comprising: reproducing rear surround signals and two-channel front stereophonic signals on the basis of an input audio signal;

adjusting relative amplitude characteristics of the two-channel front stereophonic signals and the rear surround signals;

forming a first addition signal and a first subtraction signal on the basis of the adjusted rear surround signals;

processing the first addition signal in accordance with first transfer characteristics P;

processing the first subtraction signal in accordance with second transfer characteristics N;

forming a second addition signal and a second subtraction signal on the basis of the signals processed during said steps of processing;

adding the second addition signal and one of the stereophonic signals and outputting third addition signal;

adding the second subtraction signal and the other of the stereophonic signals and outputting a fourth addition signal;

reproducing, based on said third and fourth addition signals, the two-channel front stereophonic and rear surround signals by a pair of loudspeakers to localize sound images of the rear surround signals at positions different from those at which the pair of loud speakers are arranged; and reproducing a picture relative to the reproduced signals by a display unit, the loud speakers being arranged on both sides of the display unit, wherein the transfer characteristics P and N are set, respectively as follows:

$$P=(F+K)/(S+A)$$

$$N=(F-K)/(S-A)$$

where S denotes transfer characteristics between one of the loud speakers and one of the listener's ears positioned on the same side as the loud speaker, respectively; A denotes transfer characteristics between the other of the loud speakers and one of the listener's ears positioned on an opposite side to the loud speaker, respectively; F denotes transfer characteristics between one of two positions at which two sound images are required to be localized and one of the listener's ears positioned on the same side as the image position, respectively; K denotes transfer characteristics between one of the two positions at which the two sound images are required to be localized and one of the listener's ears positioned on an opposite side to the image position; and/denotes a reverse convolution calculation.

12. The audio video reproducing method of claim 11, further comprising the steps of:

storing a plurality of transfer characteristics according to a plurality of sound image localization positions, respectively; and reading the transfer characteristics according to at least one desired sound image localization position from a plurality of stored transfer characteristics and setting the read transfer characteristics to said steps of processing.

* * * * *